United States Patent [19]

Howes et al.

[11] Patent Number: 5,056,659

[45] **Date of Patent: * Oct. 15, 1991**

[54] PRIZE HOLDING CONTAINER ASSEMBLIES

[76] Inventors: James P. Howes, 33 Cedar Rd.; Rocco Noschese, 35 Wilton Woods Rd., both of Wilton, Conn. 06897

[ * ] Notice: The portion of the term of this patent subsequent to Mar. 27, 2007 has been disclaimed.

[21] Appl. No.: 491,947

[22] Filed: Mar. 12, 1990

Related U.S. Application Data

[63] Continuation-in-part of Ser. No. 250,755, Sep. 28, 1988.

[51] Int. Cl.[5] ..... B65D 1/24

[52] U.S. Cl. ..... 206/217; 206/457; 206/831; 215/6; 215/228; 272/8 R; 426/120

[58] Field of Search ..... 206/217, 232, 457, 831; 215/6, 227, 228, 228, 1 A; 272/8 R, 8 N; 426/120, 124

[56] References Cited

U.S. PATENT DOCUMENTS

| | | | |
|---|---|---|---|
| 1,711,469 | 4/1929 | Stratford | 215/228 |
| 2,066,121 | 12/1936 | Morris | 215/229 |
| 2,724,536 | 11/1955 | Pugh, Sr. | 215/1 A |
| 3,734,276 | 5/1973 | Bank | 206/232 |
| 4,228,913 | 10/1980 | Mack et al. | 220/90.2 |
| 4,709,829 | 12/1987 | Johnson et al. | 215/1 A |

FOREIGN PATENT DOCUMENTS

| | | | |
|---|---|---|---|
| 1002595 | 11/1951 | France | 215/1 A |

*Primary Examiner*—Joseph Man-Fu Moy
*Attorney, Agent, or Firm*—Melvin I. Stoltz

[57] ABSTRACT

By providing prize award holding means cooperatingly associated with a container shell which is closed in the conventional mammer, a container assembly is achieved for randomly distributing prize awards to consumers in association with any liquid, semi-liquid, wet or moist product, without fear of consumer detection of the prize bearing containers. In accordance with the present invention, the container assembly may incorporate the actual product along with the prize award or may comprise a simulated product container bearing the prize award without the actual product, but being completely indistinguishable from non-prize bearing, product-holding containers.

36 Claims, 16 Drawing Sheets

FIG. 3
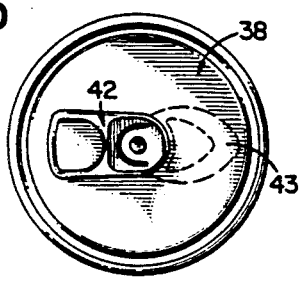
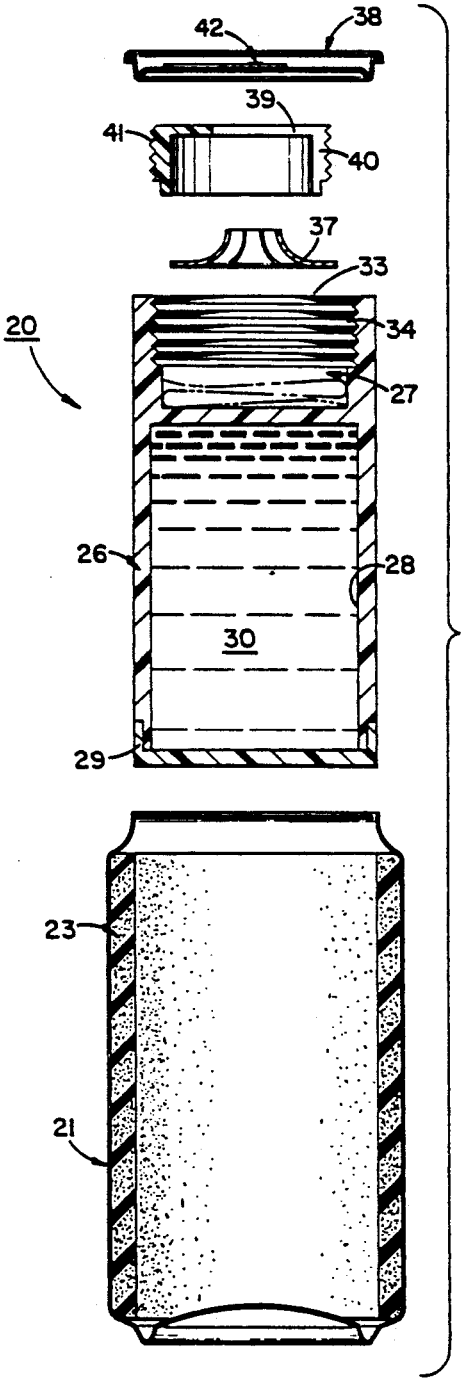
FIG. 2
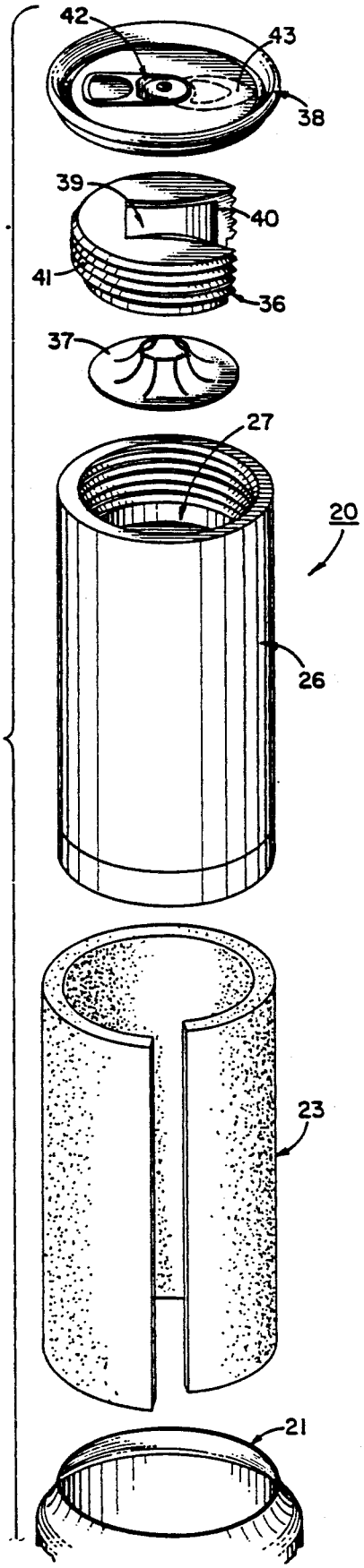
FIG. 1

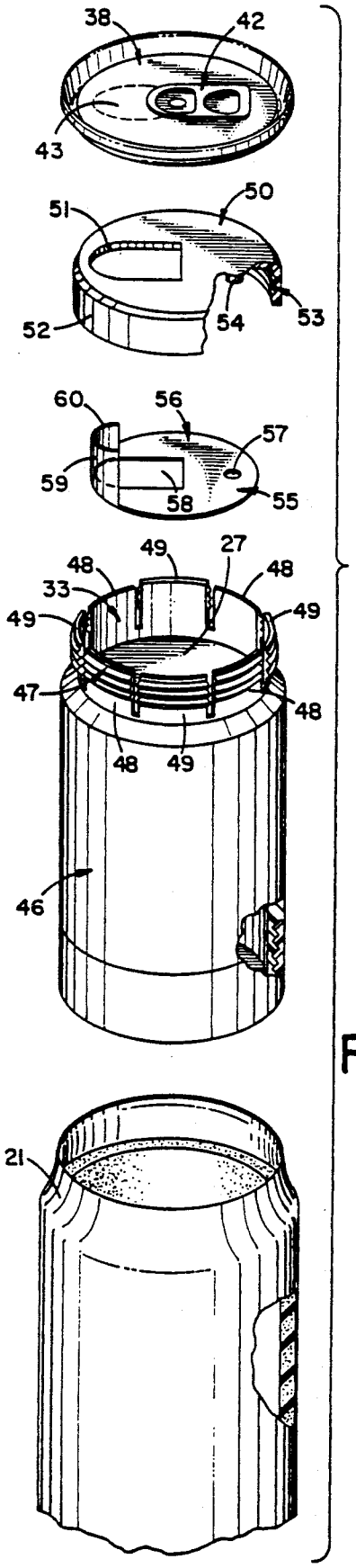
FIG. 4
FIG. 5
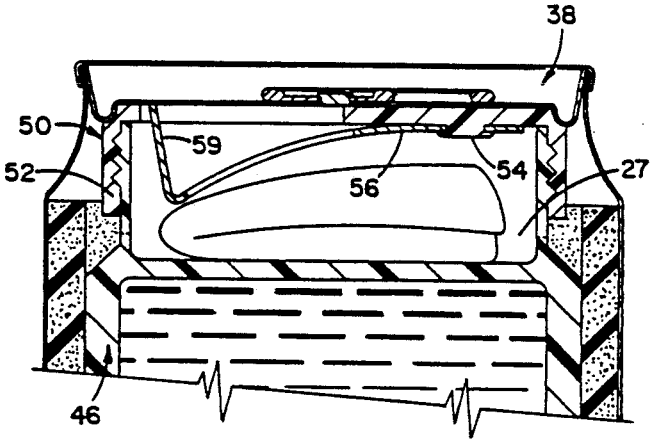
FIG. 6
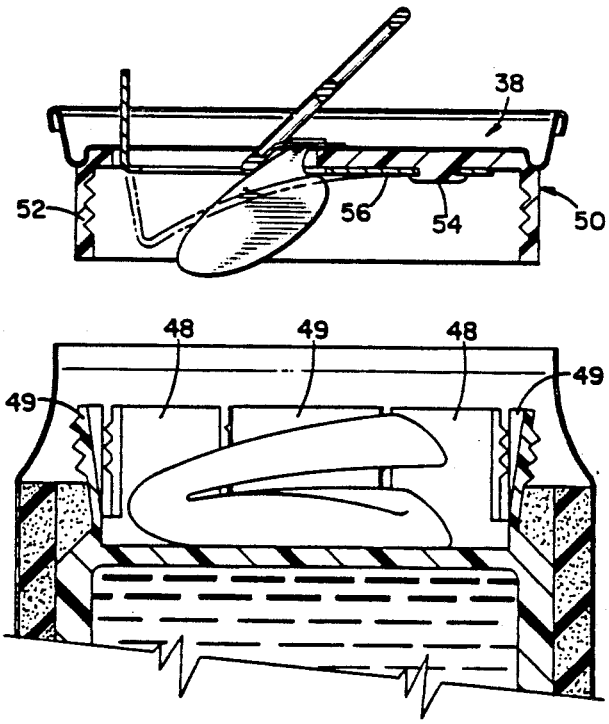

FIG. 19
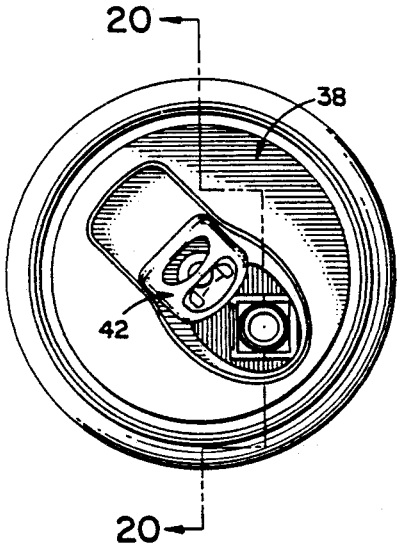
FIG. 21
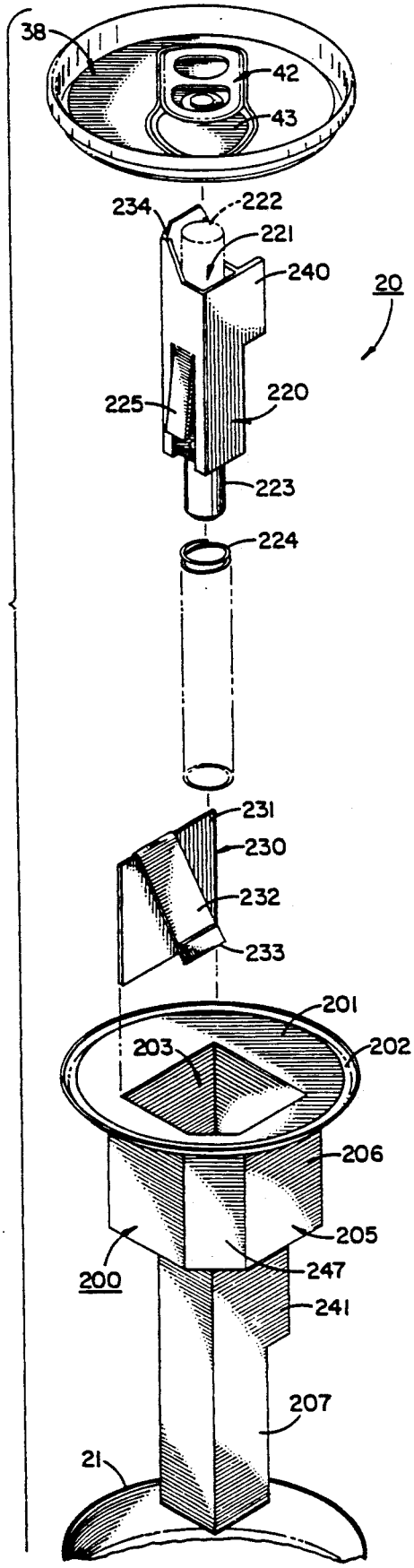
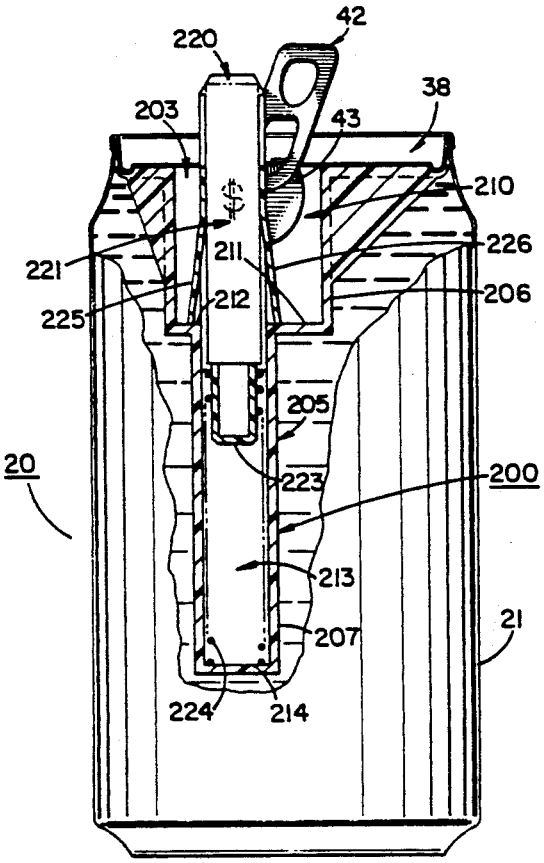
FIG. 20

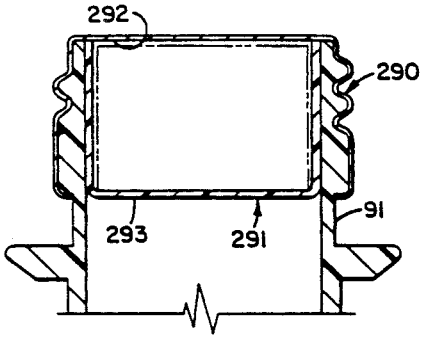
FIG. 32
FIG. 33
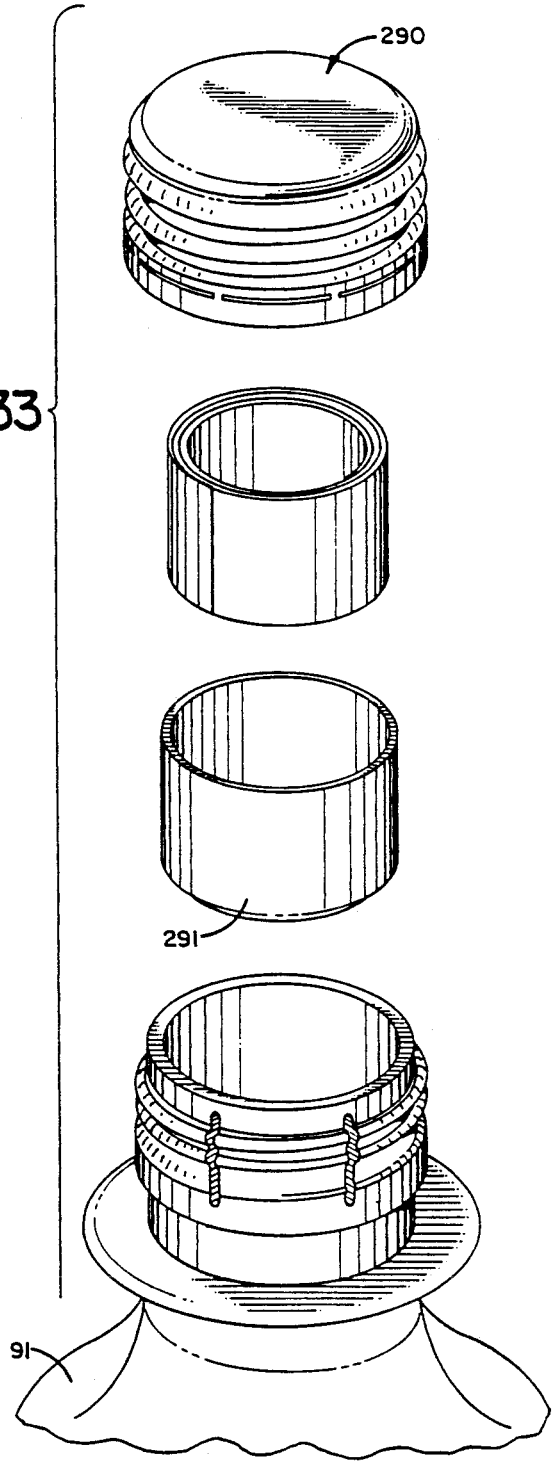
FIG. 30
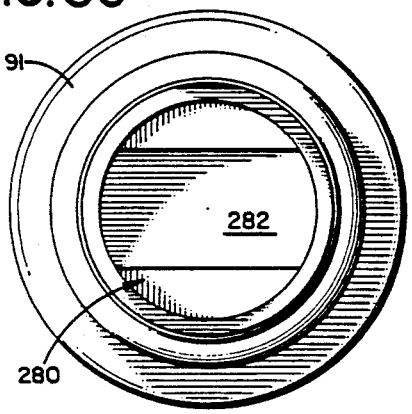
FIG. 31
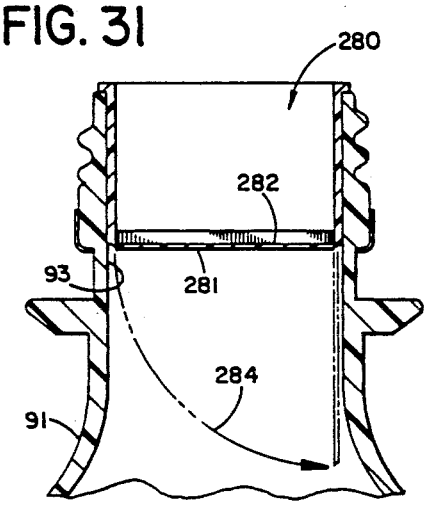

PRIZE HOLDING CONTAINER ASSEMBLIES

This application is a continuation-in-part application of U.S. Ser. No. 07/250,755, filed Sept. 28, 1988 for Prize Holding Container Assemblies.

TECHNICAL FIELD

This invention relates to containers for liquid, semi-liquid or moist products constructed for secretly retaining a high or low value prize award and, more particularly, to simulated product containers for such goods constructed for secretly retaining a high or low value prize award while being indistinguishable from genuine product containers.

BACKGROUND ART

The use of various promotional enhancements for increasing the sales of particular products is commonly employed by manufacturers or distributors for a wide variety of products. These promotional enhancements take on a variety of forms, all for the purpose of increasing product sales.

One of the promotional methods often employed by some manufacturers is the inclusion of a prize in either every product container or in selected containers. However, prior to the present invention, this promotional concept was employable only for dry products. Generally, wet or moist products have been incapable of using this type of promotional activity due to the potential for contamination that may be caused by the presence of a foreign or non-consumable prize with the product.

In order to attain greater market share for various sales, manufacturers and distributors have found increasingly unique promotional activities in order to generate added sales for their particular products. In doing so, the premium or prize type promotion has progressed from inexpensive give-aways packed in every product bearing container to expensive prize awards which are packed in selected containers, which containers are randomly distributed with non-prize bearing containers.

Unfortunately, due principally to the difficulties of contamination, product degradation or prize degradation, such incentive programs have not been capable of being employed by manufacturers or distributors of wet or moist products, particularly food products such as liquid beverages as soda, water, beer, milk, juice and the like, or moist products such as yogurt, cottage cheese, sour cream, jelly, jams, peanut butter, dips, canned fruits and vegetables, and the like. Similarly, other wet or moist consumer goods such as detergents, soaps, bleaches, automotive oils, polishes, and the like have been unable to employ this advertising technique. As a result of this inability, these manufacturers or distributors have been incapable of employing an effective product sale incentive in generating increased interest and sales of their respective products.

Consequently, it is a principal object of the present invention to provide a prize award holding container assembly for use with all liquid, semi-liquid and moist products.

Another object of the present invention is to provide a prize award holding container assembly having the characteristic features described above which forms a part of a simulated product container identical in all respects to a genuine product container, but which contains only the prize being awarded.

Another object of the present invention is to provide a simulated product container having the characteristic features described above which incorporates the outer shell of the genuine product being simulated, while comprising within the prize award as well as means to simulate both the feel and sound of the genuine product being simulated.

Another object of the present invention is to provide a prize award holding container assembly having the characteristic features described above which is virtually indistinguishable from the product bearing container being simulated and can be displayed with the product bearing containers without being detected.

Other and more specific objects will in part be obvious and will in part appear hereinafter.

SUMMARY OF THE INVENTION

By employing the present invention, the failure of the prior art to enable prize incentives or premium promotions to be used with liquid, semi-liquid, or moist products is completely overcome. In one aspect of the present invention, replicated or simulated product containers are employed to house the prize incentive, and are constructed to be identical to the genuine product container in all consumer discernable respects prior to opening the container. Only upon opening the simulated product container of this invention, the consumer is immediately informed that the consumer is a winner of the prize being awarded and is provided with instructions on how to obtain access to the prize or coupon contained in the simulated product container.

Since the simulated product container is virtually indistinguishable from the genuine product container by the consumer's external analysis, prize bearing containers can be randomly distributed with genuine product containers with complete assurance that the prize bearing containers cannot be purposefully pre-selected by the consumer. Instead, the randomly distributed prize bearing containers will be similarly randomly selected by consumers who are sufficiently lucky to win the high or low value prize award.

In the preferred embodiments, locking systems are incorporated with the simulated product containers to prevent inadvertent or unwanted opening of the prize bearing container without first having the container opened in the normal fashion as if the product were to be dispensed therefrom. In this way, any consumer having won a high or low value prize, or knowing someone who has won and seeing the manner in which the simulated product container operates, is still unable to open the simulated product containers on store shelves without actually destroying the integrity of each container.

In addition to being employable with liquid, semi-liquid or moist food-type products which are manufactured for being eaten, the present invention may also be employed with other wet or moist products used for other purposes, such as liquid detergents, soaps, bleaches, washing compositions, automotive oils, lubricants, and the like. Depending upon the type of wet or moist product being sold, the unique product construction of the present invention can be employed along with the actual product or with the product being simulated, as detailed above, for any wet, moist, liquid, or semi-liquid consumer packaged product.

The invention accordingly comprises a product possessing the features, properties, the relation of components which will be exemplified in the products hereinafter described and the scope of the invention will be indicated in the claims.

DESCRIPTION OF THE DRAWINGS

For a fuller understanding of the nature of the objects of the invention, reference should be had to the following detailed description, taken in connection with the accompanying drawings in which:

FIG. 1 is an exploded perspective view of one embodiment of the container assembly of the present invention;

FIG. 2 is a partially exploded cross-sectional side elevation view of the container assembly of FIG. 1;

FIG. 3 is a top plan view of container assembly of FIG. 1;

FIG. 4 is an exploded perspective view of an alternate embodiment of a container assembly of the present invention;

FIG. 5 is a side elevation view, partially in cross-section and partially broken away, showing the container assembly of FIG. 4 fully assembled prior to opening;

FIG. 6 is a cross-sectional side elevation view, partially broken away, of the container assembly of FIG. 4, shown in its open, disengaged configuration;

FIG. 19 is a top plan view of a further alternate embodiment of the container assembly of the present invention with the container shown in its open position;

FIG. 20 is a side elevation view, partially in cross-section, of the container assembly of FIG. 19, taken along line 20—20 of FIG. 19;

FIG. 21 is an exploded perspective view of the embodiment of the container assembly of FIGS. 19 and 20;

FIG. 30 is a top plan view of a further alternate embodiment of the present invention depicted with the sealing cap removed;

FIG. 31 is a cross-sectional side elevation view, partially broken away, of the embodiment of the container assembly of FIG. 30;

FIG. 32 is a cross-sectional side elevation view, partially broken away, of a still further alternate embodiment of the container assembly of the present invention;

FIG. 33 is an exploded perspective view of the container assembly of FIG. 32;

DETAILED DISCLOSURE

Figure 7:
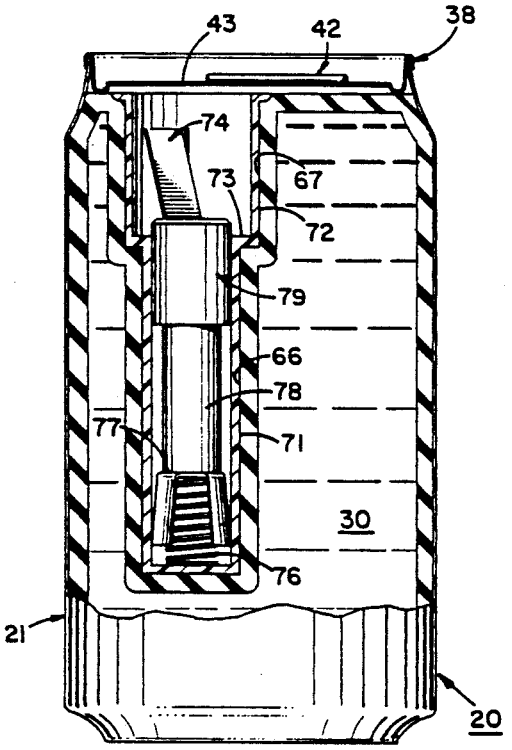
FIG. 7 is a side elevation view, partially broken away and partially in cross-section, of a further alternate embodiment of the container assembly of the present invention, shown prior to opening.

In FIGS. 1, 2, and 3, one embodiment of simulated product container 20 of the present invention is shown. In this embodiment, simulated product container 20 comprises an outer shell 21 which is in the identical form and appearance to a conventional consumable liquid holding can which container 20 is intended to simulate.

Although simulated container 20 is constructed to be identical in appearance to a conventional liquid holding can typically used for soda, beer, juices, etc., simulated product container 20 contains no consumable liquid. Instead, container 20 houses a high or low value prize. By referring to FIGS. 1, 2 and 3, along with the following detailed disclosure, the construction of this embodiment of simulated product container 20 can best be understood.

In order for simulated product container 20 of the present invention to be completely indistinguishable from the conventional liquid holding can which it is intended to simulate, simulated product container 20 must comprise not only the identical external appearance, but must also be identical to the conventional liquid holding can in both sound, weight and feel. In order to attain this virtual identity, simulated product container 20 comprises an outer can shell 21 which is identical to the can shell employed by the manufacturer or bottler of the consumable liquid for which simulated product container 20 is constructed to represent. However, instead of being filled with the consumable liquid, shell 21 contains a layer of densely packed compressible material 23 and a housing 26.

In the preferred construction, densely packed compressible material 23 peripherally surrounds the entire inside wall of shell 21. Although a variety of products can be employed for layer 23, it has been found that a layer of rubber material, densely packed foamed plastic material, blow molded, or injection molded material provides the desired inherent compressible rigidity required to effectively simulate the compression resistant forces of a conventional liquid filled can when squeezed by the consumer. As a result, any layer of compressible material which is capable of simulating the requisite compression resistance or "feel" of a conventional filled can of consumable liquid can be employed.

Directly adjacent the layer of compressible material 23 is housing 26. Preferably, housing 26 is constructed with two independent chambers, an upper chamber 27 and a lower chamber 28. As shown in FIG. 2, upper chamber 27 incorporates an enlarged entrance portal 33 and a thread-bearing sidewall 34 extending from portal 33 along the inside wall of chamber 27.

Chamber 28 preferably comprises an enlarged receiving zone into which a suitable liquid 30 is retained and sealed therein by end cap 29. End cap 29 may be secured to housing 26 in any desired manner, such as threaded engagement, friction engagement, snap lock etc. In addition, cap 29 is preferably sealed to housing 26 by conventional means, such as adhesives, sonic welding, etc., in order to prevent leakage of liquid 30 therefrom.

Liquid 30 is selected to be identical in both weight and sound to the consumable liquid for which product container 20 is constructed to simulate. In this way, when housing 26 is placed in position directly adjacent compressible material 23, a consumer selecting simulated product container 20 from a store shelf is incapable of distinguishing simulated product container 20 from the genuine liquid holding can regardless of comparisons by feel, weight or sound when the container is shaken.

The construction of this embodiment of product container 20 is completed by threaded cap 36, message disc 37, and container lid 38, which is securely affixed to cap 36. In this construction, cap 36 comprises an open portal 39 and a substantially circular, depending side wall 40 which incorporates cooperating thread means 41 formed in the outer surface thereof. Thread means 41 are constructed for mating interengagement with the thread means formed on inside wall 34 of chamber 27. Furthermore, container lid 38 is securely affixed to the top surface of thread cap 36, preferably by adhesive means.

When fully assembled, cap 36 is threadedly engaged within chamber 27 in order to securely hold therein the high or low value prize forming the gift to the consumer upon opening simulated product container 20. Depending upon the desire of the product manufacturer or distributor, the high or low value gift contained in chamber 27 may comprise any high or low value item the manufacturer or distributor wishes to award. Clearly, any prize small in size, such as currency, gemstones, car keys, or jewelry, can be easily retained in chamber 27, when suitably wrapped or folded to prevent rattling when shaken. In addition, coupons awarding substantially larger items which could not be physically positioned in chamber 27 could be placed in award chamber 27.

In order to inform the consumer that the container presently in the consumer's possession is a prize-bearing container, message disc 37 is employed. In this construction, message disc 37 comprises a substantially circular shaped disc which has been die cut with a plurality of radially extending slits to form a plurality of spring loaded arms. Disc 37 is physically placed within cap 36 directly adjacent opening 39, within the recess formed in cap 36 by depending sidewall 40.

The entire assembly is completed by securely affixing lid 38 to cap 36 and then mounting cap 36 to housing 26. When in its final position, lid 38 is positioned in overlying interengagement with the top edge of can shell 21. Once completely assembled, simulated product container 20 is both visually and physically outwardly identical to the conventional liquid holding can which container 20 is intended to simulate.

In use, a consumer purchasing simulated product container 20 opens container 20 in the normal fashion using the conventional pull tab assembly 42 of lid 38. In doing so, the pre-cut end portion 43 of tab assembly 42 breaks away from lid 38, in the conventional manner, and enters recess 39 of cap 36. Simultaneously, the arms of spring loaded die cut disc 37 are depressed until end portion 43 has passed beyond the die cut arms of disc 37, causing the spring loaded die cut arms to return to their original position directly adjacent, or emerging from, opening 39. Since each die cut arm portion incorporates a winner identification message, the consumer would immediately be notified that a high or low value prize has been won and that the prize can be obtained by rotating lid 38.

Of course, a substantial advertising effort will normally be made to promote the existence of a high or low value prize in certain selected containers. By using advertisements in newspapers, magazines, television, radio, and on the containers themselves, consumers will be informed about the promotion and that some lucky winners will be opening containers having the high or low value prize or prizes. Consequently, consumers will be looking for the winner identification message when opening the container.

Since lid 38 and threaded cap 36 are securely affixed to each other, the rotation of lid 38 causes cap 36 to rotate simultaneously therewith, thereby threadedly disengaging cap 36 from chamber 27. Once cap 36 has been removed, a consumer can quickly and easily gain access to the high or low value prize contained in chamber 27. In addition to the high or low value prize, a coupon would also typically be incorporated therein for replacement of the beverage can which the consumer had purchased.

If desired, locking means is incorporated into simulated product container 20 in order to thwart anyone with knowledge of the rotational opening of simulated product container 20 from gaining access to container 20. Of course, a plurality of alternate constructions can be employed in order to provide a suitable rotation preventing, lock system.

One such method would be to incorporate a frangible wedge between cap 36 and thread 34, positioned within portal 39. In this way, the frangible wedge would extend from cap 36 into threaded portion 34 of housing 26 to prevent the rotation of cap 36. However, whenever the simulated product container is properly opened, the pre-cut edge portion 43 of tab assembly 42 would enter portal 39, breaking the frangible wedge member. Once broken, the consumer would be able to rotate lid 38 and cap 36 in accordance with the instructions provided. Of course, if desired, any alternate lock configuration can be employed in order to attain the same results without departing from the scope of this invention.

In FIGS. 4, 5 and 6, an alternate embodiment of simulated product container 20 of the present invention is shown. In this embodiment, simulated product container 20 is constructed substantially identically to the container detailed above and shown in FIGS. 1, 2, and 3. However, in this embodiment, an alternate housing 46, cap 50 and disc 56 are employed.

As clearly shown in FIGS. 4, 5, and 6, housing 46 incorporates an upper chamber 27 and a lower chamber 28 with lower chamber 28 completely filled with liquid 30 and sealed by end cap 29, in a manner substantially identical to housing 26. However, in this construction, upper chamber 27 incorporates an enlarged entrance portal 33 which is defined by upstanding peripherally surrounding wall 47. In this embodiment, upstanding wall 47 incorporates thread means formed about the outside surface thereof.

Furthermore, upstanding wall portion 47 is defined by a plurality of independent, non-movable segments 48, and a plurality of independent, spring biased segments 49, which move outwardly when in an unloaded configuration. As will be more fully detailed below, this construction causes spring biased segments 49 forming upstanding wall 47 to form a larger diameter whenever cap 50 is removed therefrom, as shown in FIG. 6.

Cap 50 incorporates a portal opening 51, depending, peripherally surrounding side wall 52 with thread means 53 formed in the inside thereof. Furthermore, cap 50 incorporates a disc holding boss 54 extending from the inside surface thereof.

In this embodiment, message disc 56 comprises a substantially flat, flexible, thin plate 55 which incorporates a boss receiving hole 57 and an entrance portal 58 formed therein. In addition, a message bearing tab 59 extends substantially perpendicularly from plate 55, directly adjacent portal 58. By employing this construction, the winner identification message bearing tab 59 is prominently displayed to the consumer in a direct error-free manner.

In operation, this embodiment of simulated product container 20 operates in a substantially identical manner to the container previously detailed. In particular, lid 38 is securely affixed to the top surface of cap 50 in order to assure that the rotation of lid 38 also causes the rotation of cap 50. Whenever a prize-bearing container is in the consumer's possession, the consumer would employ conventional pull tab assembly 42 of lid 38, as previously described. In doing so, the pre-cut end portion 43 breaks away from lid 38 and enters recess 51 of lid 50 and portal 58 of disc 56.

As best seen in FIG. 5, when fully assembled, message disc 56 is securely affixed to cap 50 within the zone formed by depending side wall 52. In order to assure that disc 56 is in the precisely desired position, portal 58 of disc 56 is aligned with portal 51 of cap 50 and securely held in this fixed position by the interengagement and alignment of boss 54 within hole 57. Once in their proper position, boss 54 is sonicly welded or softened in the conventional manner well known in the art to securely affix disc 56 thereto.

When message disc 56 is secured in position and lid 38 is securely affixed to cap 50, plate 55 of disc 56 arcuately bends, with edge 60 of upstanding winner identification message tab 59 being held in contact directly below lid 38 by pre-cut end portion 43. This position is retained until the container is opened by the consumer.

Since plate 55 of disc 56 comprises a thin, flexible configuration, the positioning and securement of upstanding winner identification message tab 59 causes the entire disc 56 to be bent inwardly into chamber 27, placing spring forces upon the entire disc assembly. Consequently, when pull tab assembly 42 of lid 38 is activated and pre-cut end portion 43 is broken from lid 38 and enters portal 51 of cap 50, the spring forces of disc 56 cause winner identification message tab 59 to move upwardly out of its retained position to an upstanding, clearly visible position, protruding through the hole formed by the removal of end portion 43. In this way, the consumer is immediately identified of the existence of a high or low value prize within the simulated product container along with instructions on accessing the prize.

As detailed above in regard to the earlier embodiment, the consumer accesses prize retaining chamber 27 by rotating lid 38 which also causes cap 50 to rotate therewith. This simultaneous rotation of lid 38 and cap 50 causes cap 50 to be threadedly disengaged from the thread means on upstanding wall 47 and, when cap 50 is removed, access to chamber 27 through portal 33 is easily attained.

Furthermore, as detailed above, the plurality of spring biased segments 49 forming upstanding wall 47 are now allowed to move outwardly, since the retaining force of cap 50 has been removed. As shown in FIG. 6, this outward movement prevents anyone from attempting to reattach cap 50 to container 46 once the prize has been removed. As a result, no subsequent use of the simulated product container 20 of the invention can be effectuated.

In FIGS. 4 and 6, the spring biased segments 49 are shown as alternating with non-biased segments 48. However, any desired number of spring biased and non-spring biased segments can be employed, as long as re-use of the container is achieved.

Figure 9:
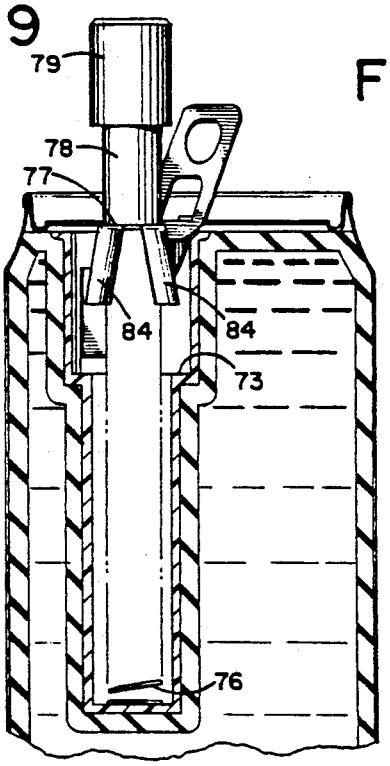
FIG. 9 is a side elevation view, partially broken away and partially in cross-section, of the container assembly of FIG. 7 shown after the container has been opened.
Figure 8:
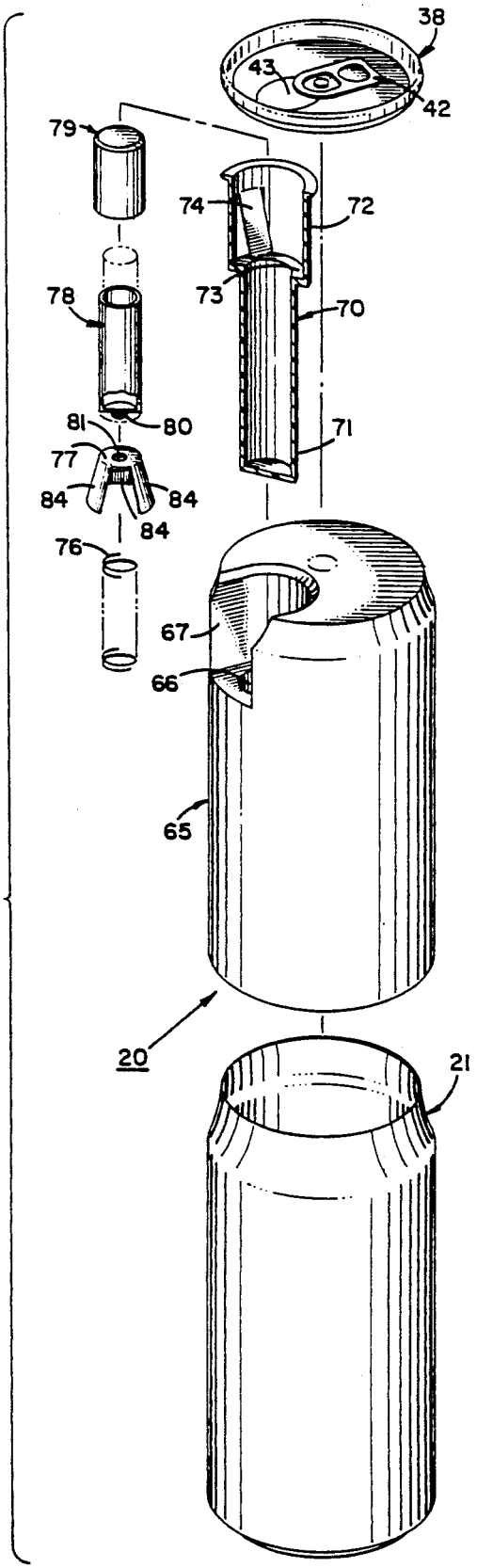
FIG. 8 is an exploded perspective view of the container assembly of FIG. 7.

In FIGS. 7, 8 and 9, an alternate embodiment for simulated product container 20 is shown in detail. In this embodiment, simulated product container 20 is constructed to completely eliminate any possibility that simulated product container 20 can be reused once the high or low value prize has been obtained by the first consumer. As with the previous embodiments, simulated product container 20 comprises an outer shell 21 which is identical in form and appearance to the conventional consumable liquid holding can which container 20 is intended to simulate. In addition, lid 38 comprises the identical construction and configuration employed for the lid of the conventional container.

As described above with the previous embodiments, this embodiment of simulated product container 20 may also comprise a layer of densely packed compressible material 23, or lightweight blow molded material, for insertion within shell 21 to peripherally surround the entire inside wall of shell 21. However, for ease of depiction, compressible material 23 has been omitted from FIGS. 7, 8 and 9.

Directly adjacent the inside wall of shell 21, or directly adjacent compressible material 23, if employed, is housing 65. As with the previous embodiments, housing 65 incorporates liquid 30 which is contained within housing 65 and sealingly retained therein. Liquid 30 is selected to be identical in both weight and sound to the consumable liquid for which product container 20 is constructed to simulate.

As best seen in FIG. 8, housing 65 comprises a shape substantially identical to shell 21 except for the incorporation of recessed zone 66 and cut away portion 67. Furthermore, cut-away portion 67 is cooperatingly associated and aligned with recess 66.

In addition to housing 65, this embodiment of simulated product container 20 incorporates an elongated, substantially cylindrically shaped wall-forming insert 70 which is constructed for mating interengagement and retention within recess 66 and cut-away portion 67 of housing 65.

In its preferred construction, insert 70 comprises a first elongated, substantially cylindrically shaped section 71, which is constructed for mating interengagement with recess 66, and a second substantially cylindrically shaped section 72 which is concentrically aligned with first section 71. Section 72 also comprises a movable,-spring arm 74 formed in the wall thereof. As detailed below, spring arm 74 provides a movably position holding and locking arm.

At the juncture between sections 71 and 72, a substantially circular peripherally surrounding edge 73 is formed, since section 72 comprises a larger diameter than section 71. As best seen in FIG. 7, first section 71 of insert 70 is nestingly engaged with recess 66 of housing 65, while second section 72 is cooperatingly aligned with cut-away portion 67 of housing 65.

The assembly of this embodiment of simulated product container 20 is completed by spring means 76, movable base 77, prize holding vial 78 and cap 79. In the preferred embodiment, prize retaining vial 78 incorporates base securement means 80 forming the bottom portion thereof which is lockingly engaged with base 77 in cooperating recess 81. As is more fully detailed below, this secure locked interengagement prevents prize retaining vial 78 from becoming unwantingly dislodged from simulated product container 20 during its operation.

In FIG. 7, simulated product container 20 is depicted in the configuration wherein a high or low value prize is securely retained within holding vial 78 and simulated product container 20 is ready for distribution and sale to the consumer in a manner whereby simulated product container 20 is indistinguishable from the genuine product bearing can. In this configuration, as shown in FIG. 7, spring 76 is maintained under compression with base 77, prize holding vial 78 and cap 79 are secured and locked in position by movable arm 74 of upper section 72 of insert 70.

When in this locked configuration, this embodiment of product container 20 is incapable of being distinguished from the genuine beverage bearing container, particularly since all of the components are securely retained in a manner which prevents any detection by sound or feel. Furthermore, as detailed above, container 65 with liquid 30 housed therein provides assurance that simulated product container 20 provides the "feel" and sound of a genuine liquid bearing container, in addition to the identical visual appearance.

When this embodiment of simulated product container 20 is selected by the consumer and brought home for use, the consumer is quickly and immediately informed, upon opening, that a high or low value prize has been won. In order to receive this notification, a consumer merely opens simulated product container 20 in the conventional manner by pulling on tab assembly 42 of lid 38. In doing so, the pre-cut end portion 43 breaks away from lid 38 in the conventional manner, and enters upper section 72 of insert 70. As end portion 43 foldingly moves in its normal, conventional manner, end portion 43 contacts spring arm 74 and forces arm 74 out of holding engagement with cap 79. Once this holding force has been removed, cap 79, prize holding vial 78, and base 77 are all moved vertically upwardly through insert 70 by spring means 76, until the position shown in FIG. 9 has been reached.

Preferably, the top surface of cap 79 incorporates a message informing the consumer that a high or low value prize has been won and can be obtained by removing cap 79. Upon removal of cap 79, the prize can be readily accessed and removed from vial 78. Although any particular prize can be employed, either currency or a coupon is most conveniently rolled and/or folded for secure retention in vial 78.

In view of the rapid movement of prize holding vial 78 due to the spring force of spring means 76, vial 78, as detailed above, is preferably securely affixed to base 77 to prevent vial 78 from being propelled out of simulated product container 20 upon reaching the opening in lid 38. Consequently, by securely affixing vial 78 to base 77, any possibility that vial 78 can be dislodged is completely eliminated.

Furthermore, in order to assure that simulated product container 20 is not reused, base 77 is constructed with a plurality of depending legs 84 extending therefrom. In addition, legs 84 are spring biased to move outwardly upon entering upper zone 72 of insert 70. As a result, as clearly shown in FIG. 9, legs 84 move outwardly into securely affixed, locked engagement with ledge 73 when prize holding vial 78 has reached the opening in lid 38. As a result, the assembly cannot be reused or re-employed in any manner by the consumer after the consumer has obtained the high or low value prize originally provided by the manufacturer.

Figure 10:
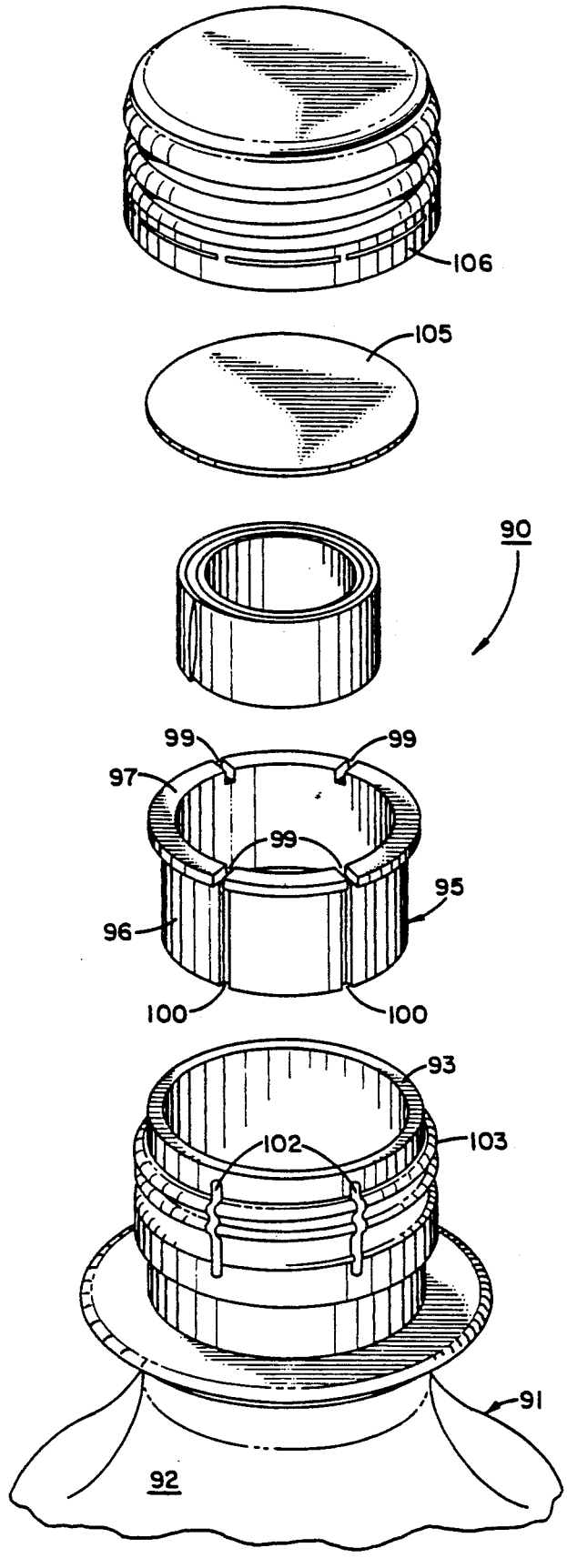
FIG. 10 is an exploded perspective view, partially broken away, of a still further alternate embodiment of the container assembly of the present invention.
Figure 12:
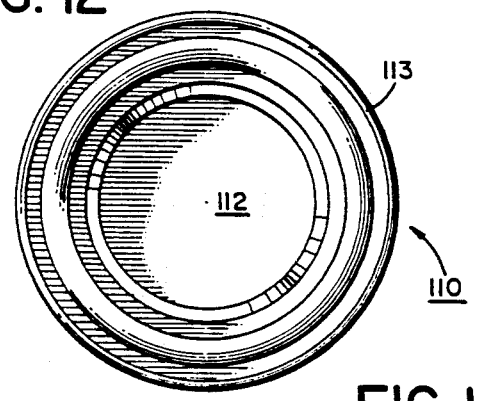
FIG. 12 is a top plan view of the container assembly of FIG. 11.
Figure 11:
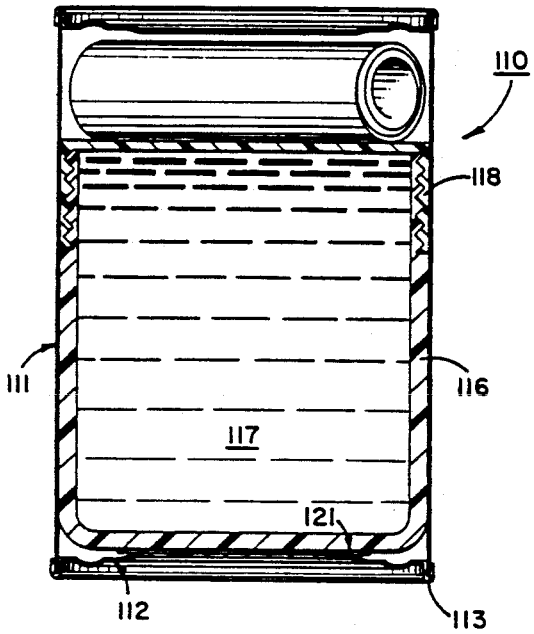
FIG. 11 is a cross-sectional side elevation view of a further embodiment of the container assembly of the present invention.

In FIG. 10, an alternate embodiment for prize bearing container 90 is depicted in detail. As with the embodiments discussed above, container 90 is constructed for being employed with liquids to be distributed in plastic or glass bottles. Typically liquid bearing bottles are employed for beverages, such as soda, juices, water and the like as well as numerous other non-edible products, such as detergents, bleaches, automotive oils, additives, anti-freeze compositions, and the like. Regardless of the product being distributed, this embodiment can be used with all liquid products sold in bottles. In addition, opaque or transparent parent bottles can employ this invention with equal efficacy. However, for exemplary purposes only, and not intending any limitation thereby, a transparent consumable beverage bottle is shown in FIG. 10, since this bottle and product is the most challenging.

Prize bearing container 90 comprises an actual beverage holding bottle 91 with the particularly desired beverage 92 retained therein. In this way, the consumer purchasing prize bearing container 90 obtains the beverage purchased, as well as the high or low value prize secretly retained therewith by employing the prize holding assembly of this invention.

As shown in FIG. 10, the high or low value prize is contained in holder 95 which is constructed to fit directly into mouth 93 of bottle 91. Holder 95 comprises a substantially cylindrically shaped cup member 96 terminating at its upper end with rim 97, which comprises a diameter greater than the diameter of cup member 96. In this way, cup member 96 of holder 95 fits snugly inside the mouth 93 of bottle 91, with the holder retained in position directly adjacent the entrance to mouth 93 of bottle 91 by the engagement of rim 97 of holder 95 with the top edge 98 of bottle 91.

In the preferred configuration, holder 95 also incorporates a plurality of through holes 99 formed in rim 97, which are cooperatingly aligned and connected to channels 100 formed in the outside wall surface of cup member 96. In this way, pressure build up caused by the carbonated gases within beverage 92 can easily escape during the opening process.

In conventional bottle constructions, vertical notches 102 are formed in thread means 103 of bottle 91. When the bottle seal is broken, the pressure build up is released through mouth 93, around top edge 98 and through vertical notches 102.

Since holder 95 of this invention closes off this normal flow path, holder 95 incorporates channels 100 and apertures 99. As a result, the gases are allowed to escape from inside bottle 91 by traveling through apertures 99 to vertical notches 102 for venting to the atmosphere. In this way, the normal escape of built-up gas pressure can be safely vented in the manner substantially achieved presently with such bottles.

The particular high or low value prize to be awarded would be inserted within holder 95 and retained therein by overlying disc 105. Preferably, disc 105 would incorporate a winner notification message informing the consumer that a high or low value prize has been won and can be accessed by removing disc 105. Once removed, the high or low value prize contained in holder 95 can be easily accessed.

In FIG. 10, the high or low value prize is shown as a high denomination currency bill rolled in compact form to fit within holder 95. However, as detailed above, the high or low value prize could be a coupon for an item which cannot be retained in holder 95, or alternatively, can be another high or low value prize such as gold or gems.

Finally, the assembly of prize bearing container 90 is completed by employing the standard screw cap 106 which is sealed in position in the normal manner presently employed in this industry. In view of the dimensions employed for holder 95, the thread engaging portion of screw cap 106 completely covers holder 95 from view, thereby preventing a consumer from being able to detect the presence of holder 95.

In addition, in order to further eliminate any possibility that holder 95 can be detected by visual inspection of prize bearing container 90, the entire outer peripheral surface of holder 95 comprises a metalized or mirrored surface. In this way, holder 95, when mounted in position within mouth 93 of bottle 91 will reflect the surrounding surfaces of container 91 or the appearance of the beverage 92 contained therein. Consequently, regardless of the manner in which prize bearing container 90 were to be tilted for viewing, the mirrored, polished or metalized surface of holder 95 would reflect its surrounding environment, thereby preventing any possibility that the presence of container 95 could be detected. In this way, the prize bearing container 90 can be randomly distributed on the shelf with non-prize bearing product containers so that lucky consumers randomly selecting prize bearing container 90 will receive the high or low value prize in the manner anticipated by the manufacturer or product promoter.

In FIGS. 11, 12, 13, and 14 another embodiment of the present invention is shown in the form of simulated product container 110. In this embodiment, prize container 110 is constructed to simulate wet or moist products retained in conventional "tin" or vacuum cans. Typically, these containers are used for consumer products such as soup, dog food and the like.

Simulated product container 110 comprises a substantially cylindrically shaped metal container shell 111 which is closed at both ends by lids 112, 112. Typically, both ends of simulated product container 110 are sealed in a substantially identical manner at both ends by lids 112, 112.

As with the embodiments previously described, can shell 111 comprises the identical can shell employed by the manufacturer in distributing the genuine product which container 110 is intended to simulate. Furthermore, some wet or moist products are distributed in cans wherein the side walls and bottom are formed as a single unitary shell. In such instances, the unitary shell construction would be used with one lid affixed at the open end to obtain a simulated product container in accordance with this invention.

In typical use, these vacuum cans are opened by physically cutting lid 112 internally about edge 113. As a result, simulated product container 110 is constructed to provide sufficient room to allow conventional can openers to be inserted adjacent edge 113 at either end of container 110 in order to remove lid 112 in the conventional manner.

In the preferred embodiment, simulated product container 110 comprises a housing 116 which is mounted within can shell 111 directly adjacent the inside wall thereof. Preferably, housing 116 is completely filled with a suitable liquid 117 and then sealed therein by cap 118. As with the embodiments previously detailed, liquid 117 would be selected to provide the identical weight and sound as the product which container 110 is intended to simulate. In this way, a consumer would be incapable of distinguishing between simulated product container 110 and a genuine product-bearing can container being simulated.

Although housing 116 may comprise a plurality of alternate configurations, the preferred embodiment is shown in FIG. 10 wherein housing 116 is constructed with an overall height less than the overall height of can shell 111. In this way, a prize retaining zone 120 is provided between cap 118 of housing 116 and upper lid 112. As shown in FIG. 10, the prize contained in simulated product container 110 is depicted as a paper roll which could be high denomination currency or a coupon redeemable for a predetermined high or low value prize. Similarly, as previously discussed, any other desired high or low value prize could be easily retained in prize holding zone 120 of container 110.

Since simulated product container 110 is constructed to be completely indistinguishable from the product which container 110 is intended to simulate, the consumer when intending to use the product thought to be purchased, would attempt to open simulated product container 110 by conventional can openers to cut off lid 112. Since, in the embodiment shown, both ends of simulated product container 110 are constructed to allow either end forming lid 112 to be removed in the normal fashion, the consumer would have no difficulty in opening simulated product container 110 in the conventional manner.

Upon opening container 110 at one end, the consumer would either immediately see the high or low value prize that has been won by gaining access to prize retaining zone 120. However, if the opposed end of container 110 were open, the consumer would be presented with a message bearing disc 121 which is secured to the bottom of housing 116.

Figure 13:
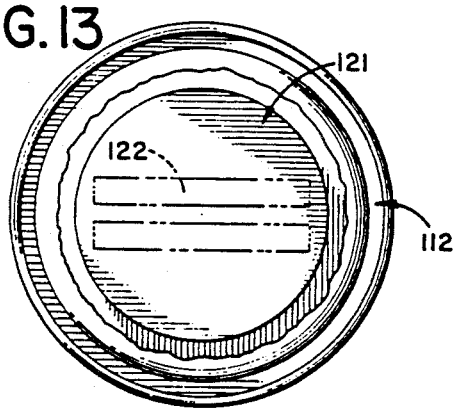
FIG. 13 is a bottom plan view, partially broken away, of the container assembly of FIG. 11.
Figure 14:
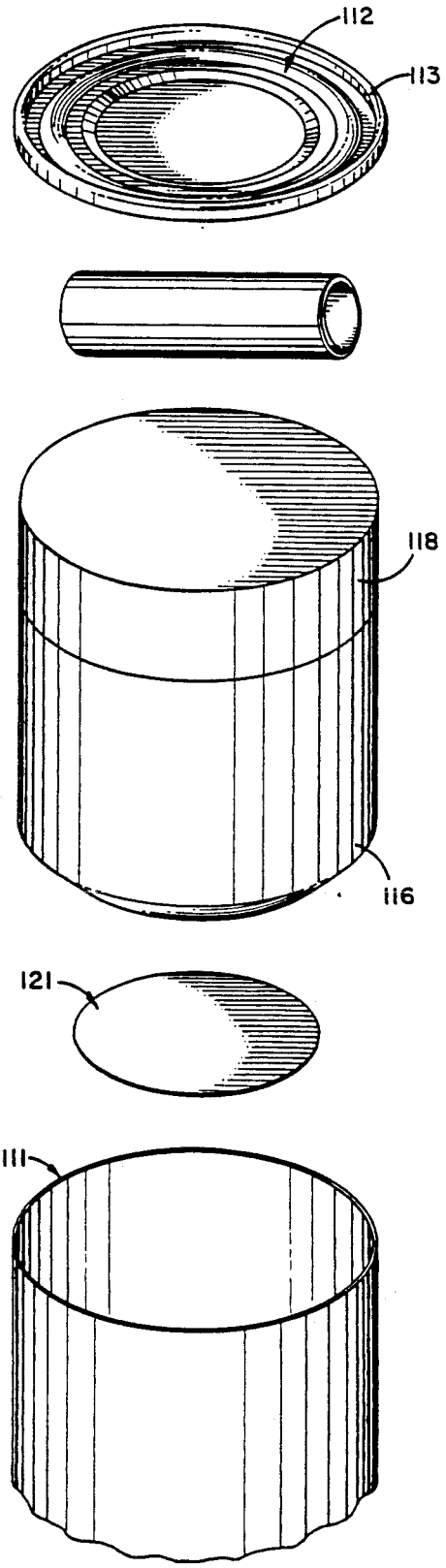
FIG. 14 is an exploded perspective view, partially broken away of the embodiment of the container assembly of the present invention shown in FIG. 11.

As best seen in FIG. 13, message 122, shown in phantom, would immediately inform the consumer that they are in possession of a prize bearing container and should immediately open the other end of the container. Once the opposed end is open, the high or low value prize retained in zone 120 would be easily accessed. Of course, no message disc need be employed with the unitary cans, since only one end can be opened by the consumer.

Figure 18:
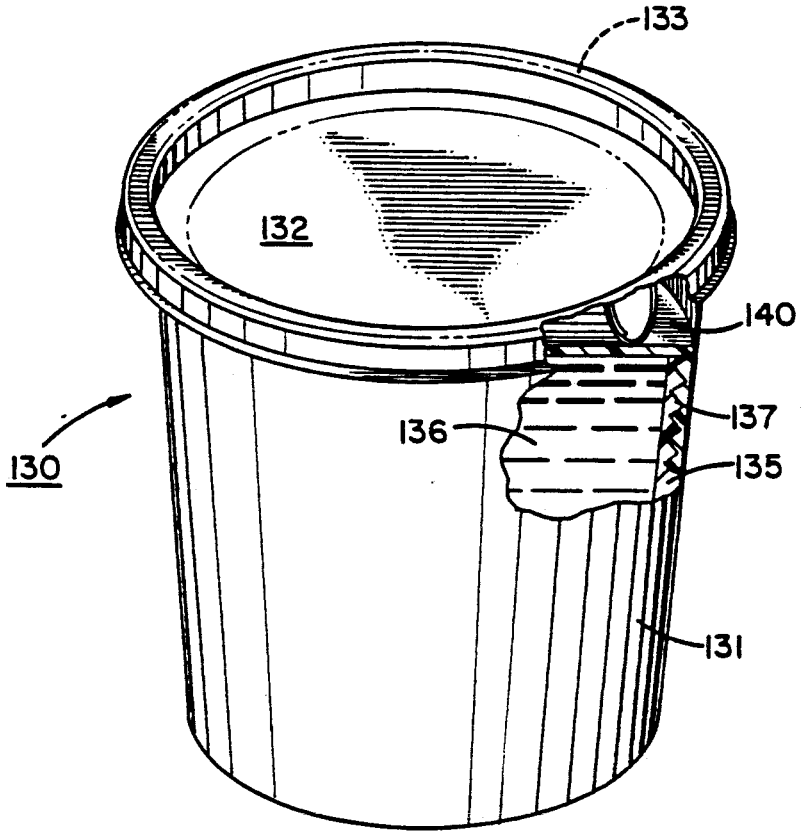
FIG. 18 is a perspective view of a further alternate embodiment of the container assembly of the present invention.
Figure 22:
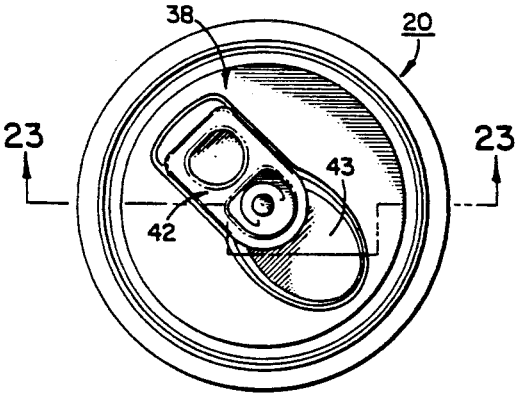
FIG. 22 is a top plan view of the container assembly of FIGS. 19–21.

Another example of a wet or moist consumable product for which the simulated product container construction of the present invention is employed is shown in FIG. 18. In this embodiment, simulated product container 130 is depicted as a conventional cardboard or plastic container usually used for yogurt, cottage cheese, or other similar wet or moist consumable products. As with the embodiments previously detailed, simulated product container 130 comprises a genuine product container 131 and lid or cover 132. In addition, the tamper resistant sealing ring 133 employed with these products would also be mounted in its conventional position. As a result, simulated product container 130 would visually appear identical to the product which container 130 is intended to simulate.

In order to assure simulated product container 130 provides the identical "feel" and sound to a consumer as does the genuine product which container 130 is intended to simulate, product container 130 incorporates a housing 135 which is positioned within shell 131, directly adjacent the side wall thereof. Housing 135 is preferably filled with a suitable liquid 136 and then sealed by cap 137 to assure liquid 136 is securely retained therein. As with the embodiments described above, liquid 136 is selected to provide the identical weight, feel and sound upon shaking as the genuine product. In this way, simulated product container 130 is virtually indistinguishable from the genuine product which container 130 is constructed to simulate.

In this embodiment, housing 135 preferably comprises a vertical height less than the vertical height of peripherally surrounding shell 131 in order to establish a prize retaining zone 140 between cap 137 and lid 132. As shown in FIG. 18, a high or low value prize is retained in this zone for delivery to the consumer when simulated product container 130 is opened.

Since simulated product container 130 is indistinguishable from the genuine product, the consumer purchasing simulated product container 130 would assume that the genuine product had been purchased. Upon intending to use the product, the tamper resistant band 133 would be removed, and then lid 132 would be removed. Once lid 132 had been removed, the consumer immediately sees a high or low value prize contained within zone 140 and then, for the first time, is provided with the realization that the high or low value prize has been won.

By employing any desired embodiment of the simulated product container of the present invention, any wet or moist product manufacturer or distributor can effectively conduct incentive promotions using the random distribution of a high value prize directly to the consumer, without the consumer ever knowing before opening the container that the high or low value prize is retained in the product being purchased. In this way, complete random distribution to totally anonymous purchasers can be attained, showing the highest level of integrity and honesty of product distribution to the winning consumers.

Figure 16:
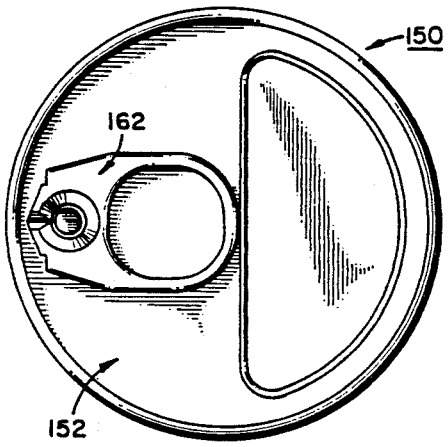
FIG. 16 is a top plan view of the container assembly embodiment of FIG. 15.
Figure 17:
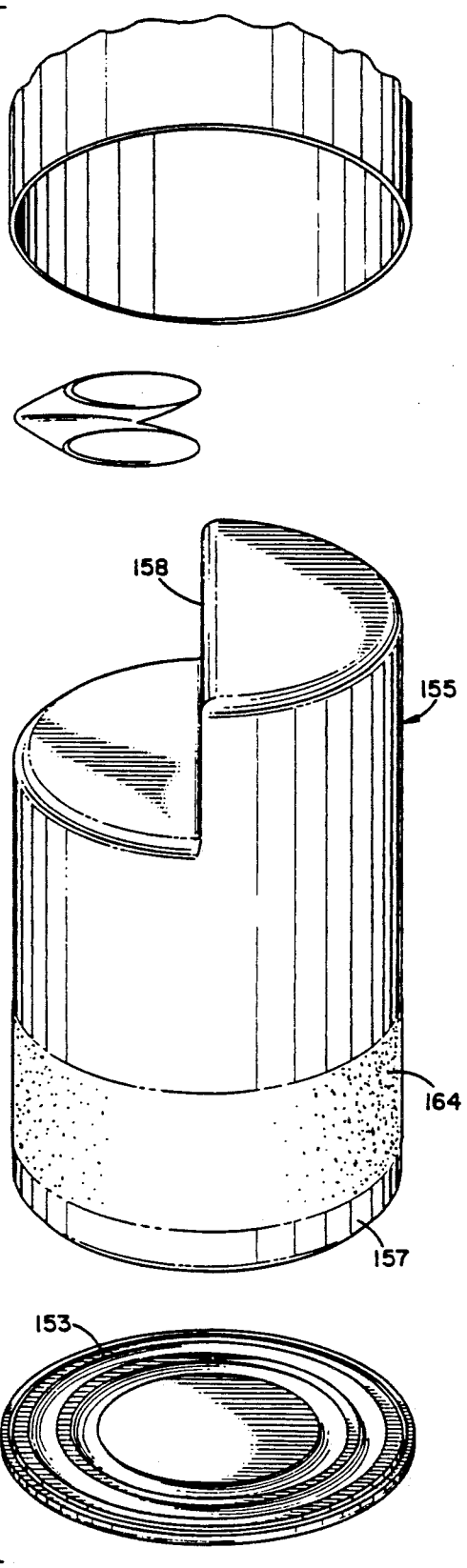
FIG. 17 is an exploded perspective view of the container assembly embodiment of FIG. 15.
Figure 15:
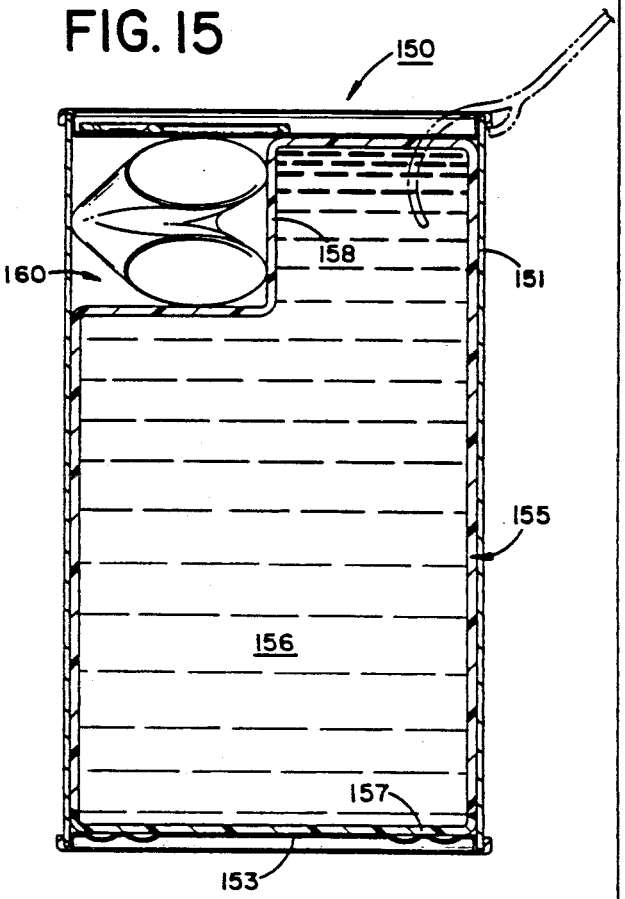
FIG. 15 is a cross-sectional side elevational view of a still further embodiment of the container assembly of the present invention.

In FIGS. 15, 16 and 17, an alternate embodiment of the present invention is shown in the form of simulated product container 150. In this embodiment, simulated product container 150 is constructed to house a high or low value prize for distribution in containers similar to containers employed for various liquid automotive products. However, any wet or moist product distributed in this type of container can employ the teaching of this invention.

Typically, these containers comprise a substantially cylindrical shell 151 which is sealed at one end by upper lid 152 and at the other end by lower lid 153. As with the previous embodiments, cylindrical shell 151 would comprise the actual cylindrical shell employed for which the product container 150 is intended to simulate. Similarly, both lids 152 and 153 would also comprise the actual lid configuration employed in the genuine product can.

Internally, however, simulated product container 150 comprises a housing 155 which is completely filled with liquid 156. Liquid 156 is sealingly retained in housing 155 by cap 157 which is affixed to housing 155.

If desired, liquid 156 may comprise a simulated liquid which would provide the consumer with the "feel" and sound of the actual liquid product container 150 is intended to simulate. However, since the liquid distributed in this embodiment does not comprise a consumable liquid, the actual automotive liquid for which container 150 is intended to simulate can be sealed within housing 155. In this way, consumers would not only receive a chance of winning a high or low value prize, but would also be able to get the actual product for which container 150 had been purchased.

As shown in FIGS. 16 and 17, housing 155 is constructed with dimensions substantially identical to peripherally surrounding shell 151, except for the incorporation of a stepped wall 158 which establishes the prize retaining zone 160. As depicted, the high or low value prize may comprise a high denomination U.S. currency rolled to fit into zone 160, or a coupon redeemable for a high or low value prize.

In order to access simulated product container 150, a consumer would employ pull tab assembly 162, expecting to open a pre-cut portion of lid 152 to allow the liquid contained therein to be poured out into the consumer's automobile. However, in this embodiment, pull tab assembly 162 would be employed and would provide the consumer with access to prize retaining zone 160 so that the consumer would be able to remove the high or low value prize contained therein.

In addition, the consumer would also be instructed that housing 155 contains the product which the consumer had expected to be within simulated product container 150 and that the product can be accessed by opening housing 155 by employing conventional can openers, as depicted in FIG. 16. In this way, the consumer is able to immediately enjoy the high or low value prize which has been won as well as use the product the consumer thought was being purchased when selecting simulated product container 150 from the store shelves.

As shown in FIG. 17, if desired, housing 155 incorporates an adhesive band 164 formed about the outer peripheral surface of housing 155. Adhesive band 164 is employed in order to securely retain housing 155 in the particularly desired position relative to shell 151. Of course, adhesive band 164 is optional and would only be employed in those particular configurations where possible movement of the housing could result in potential detection of the simulated product container. However, adhesive band 164 would be employed only in those situations where required and need not be used in configurations where the housing would not be capable of movement.

In FIGS. 19 through 25, a further alternate embodiment for the simulated product container 20 of the present is shown in detail. In this embodiment, simulated product container 20 is constructed in a manner which minimizes the components required to attain container 20, while also assuring that the resulting simulated product container is incapable of being reused after the prize award has been found by the consumer. In addition, this embodiment of simulated product container 20 also provides a construction which is capable of being manufactured and completely assembled expeditiously, with a minimum of difficulty and expense.

As with the previous embodiments detailed above, simulated product container 20 comprises an outer shell 21 which is identical in form and appearance to the conventional consummable liquid holding can which container 20 is intended to simulate. In addition, lid 38 comprises the identical construction and configuration employed for the lid of the conventional container.

In this embodiment, the requirement for a liquid filled housing is eliminated, as well as the need for a layer of densely packed compressible material. Instead, in this embodiment, simulated product container 20 incorporates a prize assembly holding member or housing 200 which is sealingly affixed to lid 38. As detailed below, prior to sealingly mounting lid 38 to outer shell 21, shell 21 is filled with a suitable liquid which effectively fills simulated product container 20, providing the desired weight, feel, and sound, rendering simulated product container 20 completely indistinguishable from a genuine product container.

Figure 23:
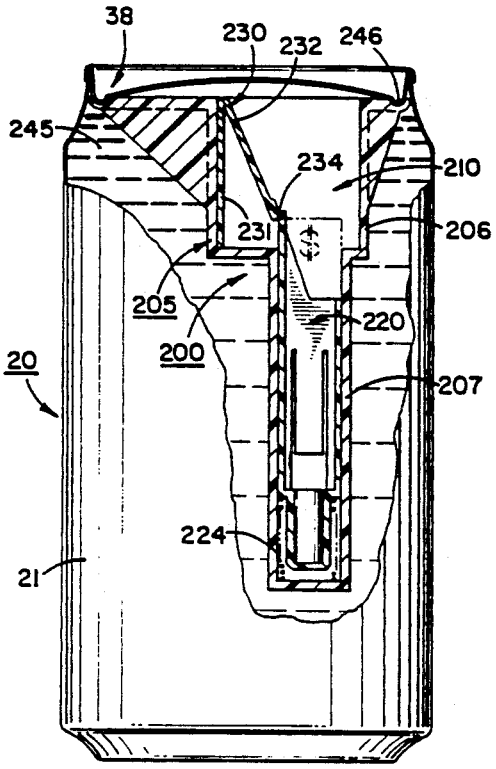
FIG. 23 is a side elevation view, partially in cross-section, of the container assembly of FIGS. 19–22, taken along line 23—23 of FIG. 22.

As best seen in FIGS. 20, 21 and 23, prize assembly holding member or housing 200 comprises an elongated, two-tier chamber assembly 205, formed by an upper enlarged cavity 206, and a lower, elongated, closed end conduit 207 communicating at its open end with the base of upper enlarged cavity 206. In addition, prize assembly holding member or housing 200 incorporates a circular, substantially flat upper surface 201 formed about the top of cavity 206. Upper surface 201 is peripherally surrounded by a circular sealing groove or channel 202, and incorporates an enlarged portal zone 203 formed therein, which comprises the portal opening to upper enlarged cavity 206.

Upper enlarged cavity 206 incorporates a substantially open zone 210 extending from portal opening 203 to base 211 of cavity 206. In addition, base 211 incorporates a portal 212 formed therein which forms the entry to elongated open zone 213 of conduit 207. In order to assure that open zones 210 and 213 remain completely free of any unwanted liquid, elongated conduit 207 comprises an end closing base 214 which sealingly closes zone 213, assuring that the interior surfaces and open zones of two tier chamber assembly 205 remain completely dry.

In the preferred embodiment, a prize holding assembly is securely mounted in the open zones of two tier chamber assembly 205 in a manner similar to the construction detailed above in reference to FIGS. 7 through 9. In this embodiment, a prize holder 220 is employed which incorporates a substantially rectangular shape and has an elongated, open ended cavity 221 formed therein in which the desired prize award is securely retained. In the drawings, the prize award is depicted in phantom, as a rolled currency 222. Of course, as detailed above, the prize award can comprise any desired currency amount or a certificate awarding a particular prize to the winner.

As shown throughout the referenced drawings, prize holder 220 incorporates a size and shape constructed for providing free, sliding, mating, telescoping engagement of holder 220 in open zone 213 of conduit 207. In addition, in order to provide the desired automatic sliding movement of prize holder 220 from a first retained position to a second fully extended position, prize holder 220 incorporates a post 223 extending from the base of prize holder 220, which is dimensioned for peripherally surrounding and matingly engaging with spring means 224.

Prize holder 220 also incorporates outwardly biased, spring arm members 225 and 226 formed on opposed sides of holder 220. Spring biased arms 225 and 226 assure that prize holder 220 is securely retained in its second, fully extended position, once simulated product container 20 has been opened. As clearly shown in FIG. 20, when prize holder 220 is released for movement from its retained position into its fully extended position, a portion of prize holder 220 extends through the portal opening formed in lid 38 by the removal of end portion 43. When in this second position, spring biased arms 225 and 226 move outwardly from their stowed position, adjacent the walls of conduit 207, to their fully extended position, lockingly engaging arms 225 and 226 on surface 212 of upper cavity 206. In this way, prize holder 220 is securely locked in its fully extended, prize presenting position, assuring immediate access by the consumer to the prize award retained in holder 220, as well as assuring that the simulated product container 20 can be employed only one single time, and not reused.

Figure 24:
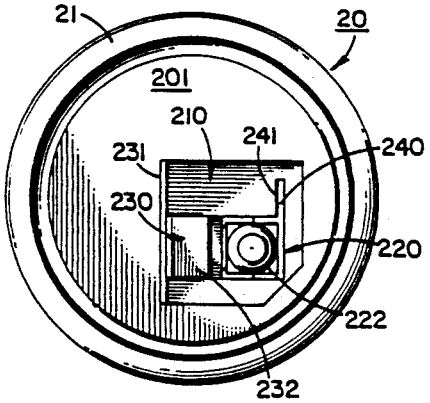
FIG. 24 is a top plan view of a container assembly embodiment of FIGS. 19–23, depicted with the lid of the container removed.

In order to securely retain prize holder 220 in its first, securely retained position and enable prize holder 220 to automatically move into its fully extended, prize presenting position when simulated product container 20 is opened, prize holder locking means 230 is employed. As shown in FIGS. 21, 23, and 24, prize holding locking means 230 incorporates a position establishing stabilizing plate 231 and a spring biased flexible arm 232 extending from the upper edge of plate 231. Arm 232 incorporates a holder engaging edge 233 formed at the distal end of flexible arm 232. In order to assure that arm 232 of locking means 230 securely holdingly engages and retains prize holder 220, prize holder 220 incorporates a lock receiving ledge 234 formed along an outer surface thereof near its upper end, for mating contacting engagement with edge 233 of arm 232.

Locking means 230 is securely positioned within open zone 210 of upper enlarged cavity 206, with stabilizing plate 231 positioned in secure abutting contact with a side wall of cavity 206. In this way, flexible arm 232 extends from stabilizing wall 231 with engaging edge 233 thereof positioned in secure, locking, retaining engagement with ledge 234 of prize holder 220. In this way, prize holder 220 is securely retained in its first position in elongated conduit 207, with spring 204 fully compressed, ready to propel prize holder 220 upwardly, when released.

With prize holder 220 securely locked in its first position, simulated product container 20 is able to sustain all of the diverse types of handling typically experienced during shipping and product distribution. By employing this construction, it has been found that simulated product container 20 is easily randomly distributed with genuine product bearing containers, with prize holder 220 being securely retained throughout the distribution cycle, until simulated product container 20 is open by a consumer. As a result, consumers are able to randomly choose simulated, prize holding container 20, without in any way suspecting that the container selected houses a prize award.

Figure 25:
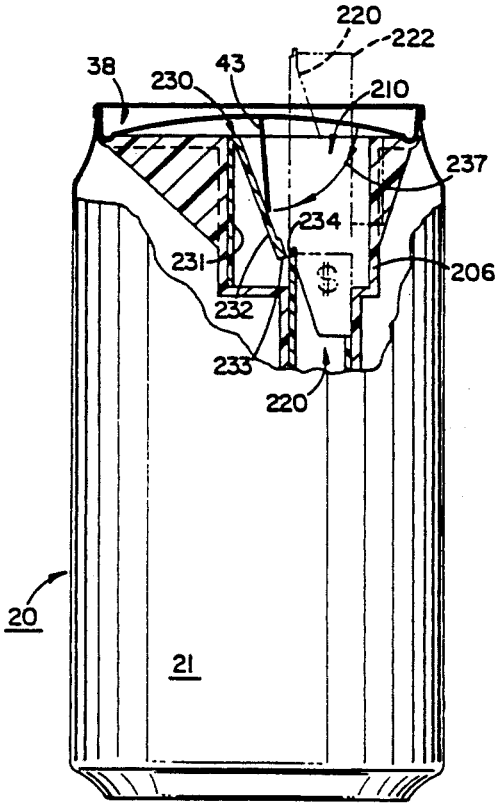
FIG. 25 is a side elevation view, partially in cross-section, of the embodiment of the container assembly of FIGS. 19–24.
Figure 26:
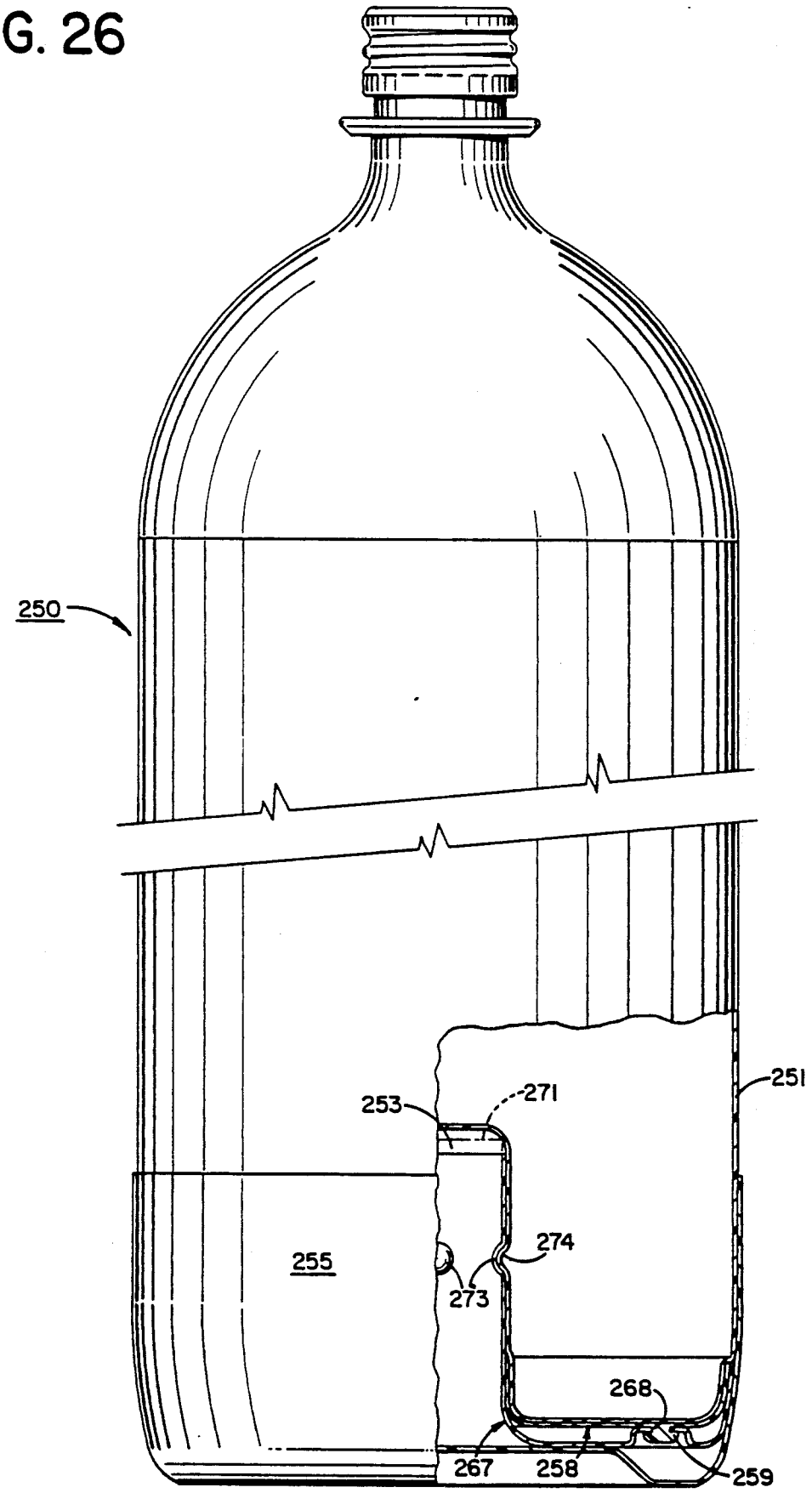
FIG. 26 is a side elevation view, partially in cross-section, and partially broken away of a still further alternate embodiment of the container assembly of the present invention.

In addition to assuring that prize holder 220 is securely held in its first, retained position throughout the distribution cycle, this embodiment of the present invention also assures that prize holder 220 is automatically released from its first retained position whenever tab assembly 42 of lid 38 is employed to open simulated product container 20. As depicted in FIG. 25, when tab assembly 42 is raised away from the top surface of lid 38, pre-cut end portion 43 automatically folds downwardly into open zone 210 of cavity 206 along the path shown by arrows 237.

As part of this arcuate movement, end portion 43 contacts arm 232 of locking means 230, causing arm 232 to move towards plate 231. In doing so, engaging edge 233 is displaced from secure, locked engagement with ledge 234 of prize holder 220, releasing prize holder 220 from its first, securely retained position and allowing prize holder 220 to be longitudinally propelled upwardly by spring means 224 into its second, fully extended position, depicted in phantom in FIG. 25. In this way, the consumer becomes immediately aware that a prize has been won, with prize 222 being presented to the consumer through the opening formed in lid 38.

In order to assure that prize holder 220 telescopically advances along the central axis defined by elongated conduit 207, while also being precisely positioned for passage through the opening in lid 38 formed by the removal of end portion 43, prize holder 220 incorporates a position aligning and stabilizing fin 240 extending outwardly from one surface thereof. In addition, elongated conduit 207 of two tier chamber assembly 205 incorporates a fin receiving slot 241 constructed for sliding receipt and controlled orientation of prize holder 220.

As shown in FIG. 24, position aligning and stabilizing fin 240 extends substantially perpendicularly from one side surface of prize holder 220 and is slidably retained within fin receiving slot 241. Although prize holder 220 is preferably constructed with a substantially rectilinear configuration, in order to avoid unwanted rotation of the prize holder, fin 240 assures that prize holder 220 does not rotate about its central axis as prize holder 220 telescopically advances between its first retained position to its second fully extended position.

Furthermore, as best seen in FIG. 19, fin 240 increases the overall width of the side edges of prize holder 220, thereby preventing the entire prize holder from passing through the opening formed in lid 38 by the removal of pre-cut end portion 43. As a result, fin 240 abuts the underside of lid 38, preventing prize holder 220 from being able to pass in its entirety through the opening formed in lid 38. In this way, this embodiment of the invention assures that no component of the prize holding system is capable of emerging from retained engagement within simulated product container 20, thereby preventing any possibility that an injury might occur to a consumer upon opening container 20.

In addition, fin 240 and receiving slot 241 in combination with the overall configuration of prize holder 220 assures that the movement of prize holder 220 from its first position to its second, fully extended position, places prize holder 220 in a position which will enable the upper portion of prize holder 220 to pass through the open portal of lid 38, presenting the prize retained therein to the consumer. In this way, immediate knowledge and recognition of the prize award by the consumer is assured.

In order to provide a simulated product container 20 which is indistinguishable by the consumer from a genuine product bearing container, this embodiment of simulated product container 20 is completely filled with a carbonated liquid 245 which will provide container 20 with all of the identical physical attributes possessed by a genuine product container. In order to assure that liquid 245 provides the identical forces upon the inside walls of container 21 as provided by the genuine product, this embodiment of simulated product container 20 is assembled in a manner substantially identical to the assembly of a genuine product bearing container. However, in filling container 21 with liquid 245, the liquid level employed for container 20 is less than a genuine product container, since the volume occupied by prize assembly holding member or housing 220 must be accommodated. Consequently, in filling container 21 with liquid 245, the liquid is added to container 21 to a preset level, which will be sufficient to completely fill container 21 once housing 200 has been positioned in container 21.

In the preferred embodiment, prize assembly holding member or housing 200 is securely, integrally affixed to lid 38. In the preferred assembly process, circumferential ring 246 of lid 38 is bonded directly to circular sealing ring 202 of upper surface 201 of housing 200. This particular bonded interengagement must be capable of withstanding internal pressures imparted thereon by liquid 245 and assure a leak-free sealed interengagement therebetween.

Once lid 38 has been intimately bonded to housing 200, the assembly of simulated product container 20 is completed by inserting housing 200 into container 21, displacing the liquid 245 previously positioned therein and sealingly mounting lid 38 to container 21 in the conventional manner. In this way, a simulated product container 20 is attained which is completely indistinguishable from genuine product bearing containers while providing a completely reliable, trouble-free prize bearing assembly for awarding a predesignated prize to a lucky consumer.

In addition to providing a completely sealed, liquid-tight simulated product container 20, which is indistinguishable from genuine product bearing containers, the sealing interegagement of lid 38 with housing 200 prior to affixing lid 38 to container 21 also assures that prize holder 220 is positioned in the precisely desired orientation for passage through the portal opening formed in lid 38 when pre-cut end portion 43 is removed. In the preferred embodiment, in order to provide assembly ease and accurate positioning, upper enlarged cavity 206 incorporates a position defining flat surface 247 which is aligned with the forward edge of pre-cut end portion 43, prior to sealingly engaging housing 200 with lid 38.

By incorporating flat surface 247 on housing 200, a readily identifiable reference location is established for positioning lid 38 relative to housing 200 prior to sealingly affixing lid 38 to housing 200. In this way, rapid and accurate assembly is assured, while the precisely desired position and alignment required for trouble-free operation is established. As a result, a simulated product is attained which can be manufactured quickly and easily, with a minimum of parts and provides dependable, repeatable, trouble-free operation.

In FIGS. 26–29, an alternate embodiment for distributing a prize in direct association with a wet or moist product is disclosed. In this embodiment, prize bearing container 250 is depicted as a conventional appearing beverage container 251 which is formed with a substantially enlarged internal cavity 253, formed in the base thereof. Depending upon the particular types of prizes to be awarded, cavity 253 can be constructed in any desired size or configuration. Consequently, cavity 253 can be a small cavity for housing currency or a prize certificate or a substantially enlarged cavity sufficient to hold radios, cameras, and the like.

Regardless of the size desired for cavity 253, the preferred embodiment of prize bearing container 250 is constructed with the actual product being retained within container 251. In this way, the consumer is able to enjoy the actual product purchased, while also being capable of receiving a prize award, if the consumer is lucky enough to have selected prize bearing container 250.

In this embodiment of the present invention, prize bearing container 250 comprises a beverage bottle incorporating a separate opaque support base 255. In this way, the existence of cavity 253, as well as the prize contained therein is completely obscured from view, thereby assuring that a consumer cannot detect the presence of a prize award and purposefully select prize bearing container 250 from the store shelves.

In addition to visually obscuring the presence of a prize in container 250, container 250 is also constructed to assure that opaque base 255 remains in locked engagement with container 251 until the consumer has opened container 251. In this embodiment, the opening of bottle 251, which causes the pressure of carbonated liquid 254 to be relieved, is used to release the base locking system. Of course, although this embodiment of the present invention is described in relationship to a container for carbonated beverages, a similar construction can be employed for any product container, regardless of the product housed therein.

In the preferred embodiment, a keyplate 258 is directly affixed to the base of bottle 251, forming an integral construction therewith. Preferably, keyplate 258 is sonically welded to bottle 251, in order to assure secure affixation of plate 258 to bottle 251.

In its preferred construction, a plurality of locking fingers or pins 259 extend from the bottom surface 260 of keyplate 258. As detailed below, locking pins 259 are constructed for mating, locked interengagement with pin receiving recesses 268 formed in keyway plate 267 of base 255.

In addition, keyplate 258 also incorporates a centrally disposed aperture 261, which is positioned for coaxial alignment with cavity 253 of bottle 251. As a result, when keyplate 258 is bonded to the base of bottle 251, cavity 253 is open and accessible through portal 261.

In addition, bottle 251 is constructed with the bottom outwardly facing surface thereof comprising a recessed zone 263 peripherally surrouding bottle 251. In this way, upwardly extending flange 264 of keyplate 258 is affixed in nested interengagement with the base of bottle 251, with the outer surface of bottle 251 being substantially continuous, without displaying any outwardly extending ridge or diameter variation.

Base 255 comprises a conventional stacking base typically affixed to the bottom of bottles 251. However, in the present invention, a prize holding keyway plate 267 is affixed to the interior of base 255 by bonding, gluing or sonic welding. Keyway plate 267 incorporates a plurality of arcuately extending keyways 268 which are constructed for mating, locking interengagement with locking pins 259 of keyplate 258.

In addition, keyway plate 267 also incorporates a centrally disposed upstanding prize retaining zone 270 which is constructed for axial aligned engagement with portal zone 261 of keyplate 258 and cavity 253 of bottle 251. In the preferred embodiment, the particularly desired prize is positioned in retaining zone 270. Although any desired prize award could be employed and could be inserted in retaining zone 270, the prize award as depicted in the figures, in phantom, as rolled currency 271.

Figure 27:
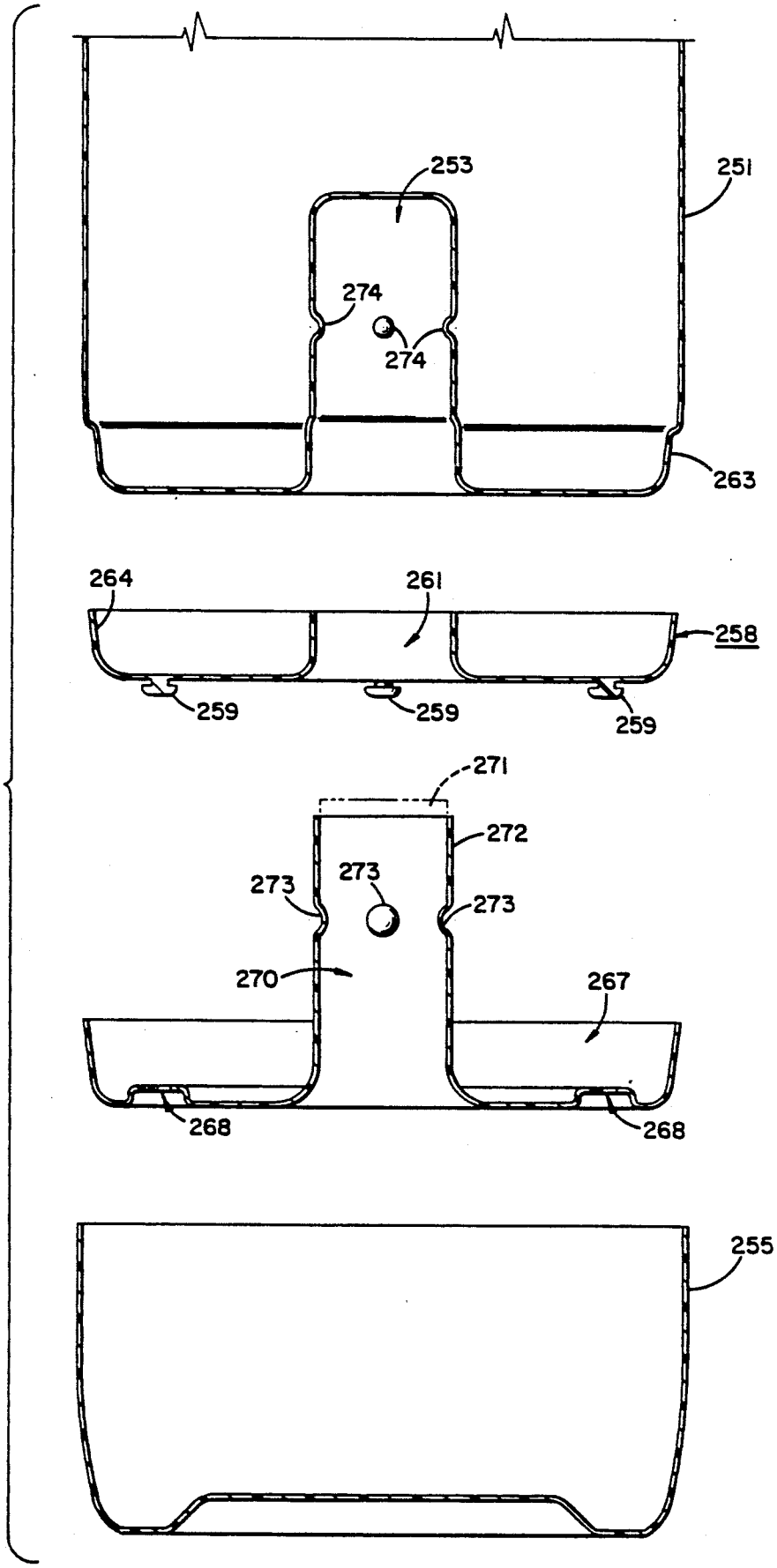
FIG. 27 is an exploded, cross-sectional side elevation view, partially broken away, of the container assembly of FIG. 26.
Figure 28:
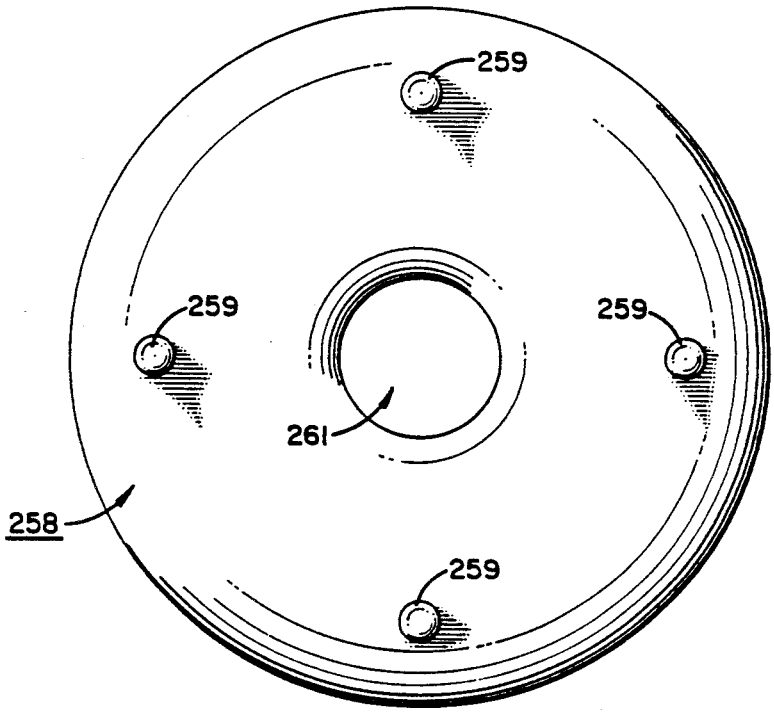
FIG. 28 is a bottom plan view of the keyplate employed in the embodiment of the container assembly depicted in FIGS. 26 and 27.
Figure 29:
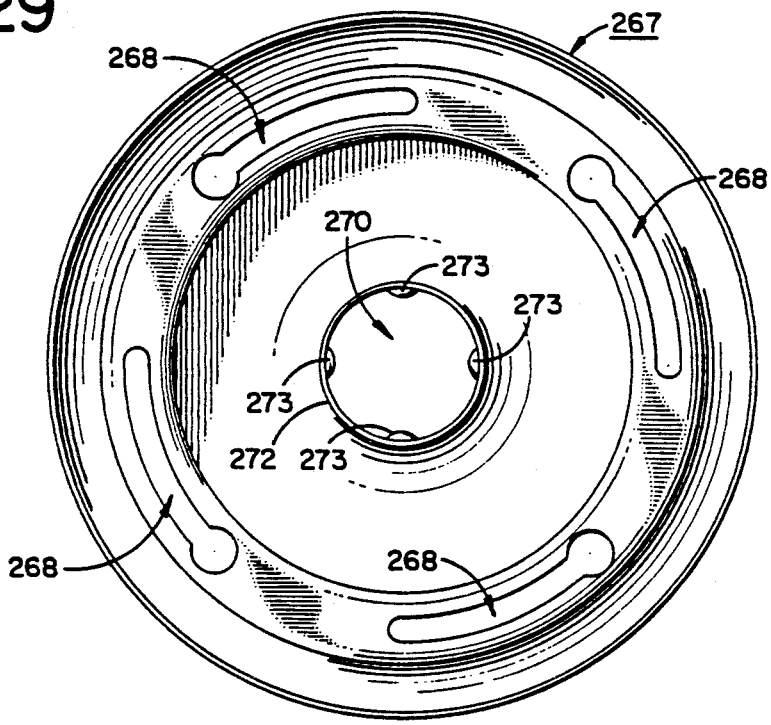
FIG. 29 is a top plan view of the keyway plate and base of the embodiment of the container assembly of the present invention depicted in FIGS. 26 and 27.
Figure 34:
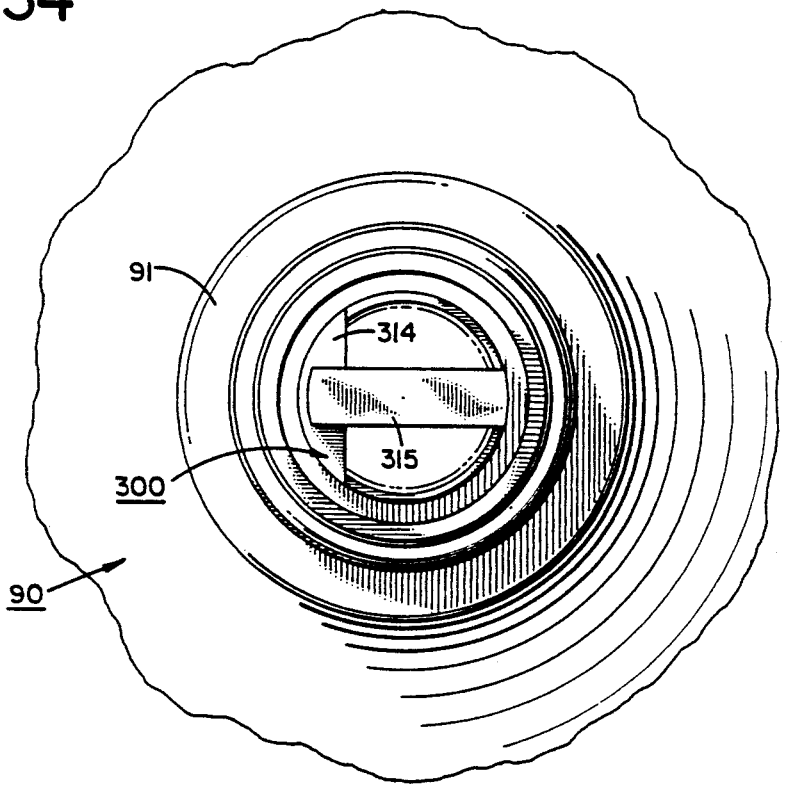
FIG. 34 is a top plan view, partially broken away, of another additional embodiment of the container assembly of the present invention.
Figure 35:
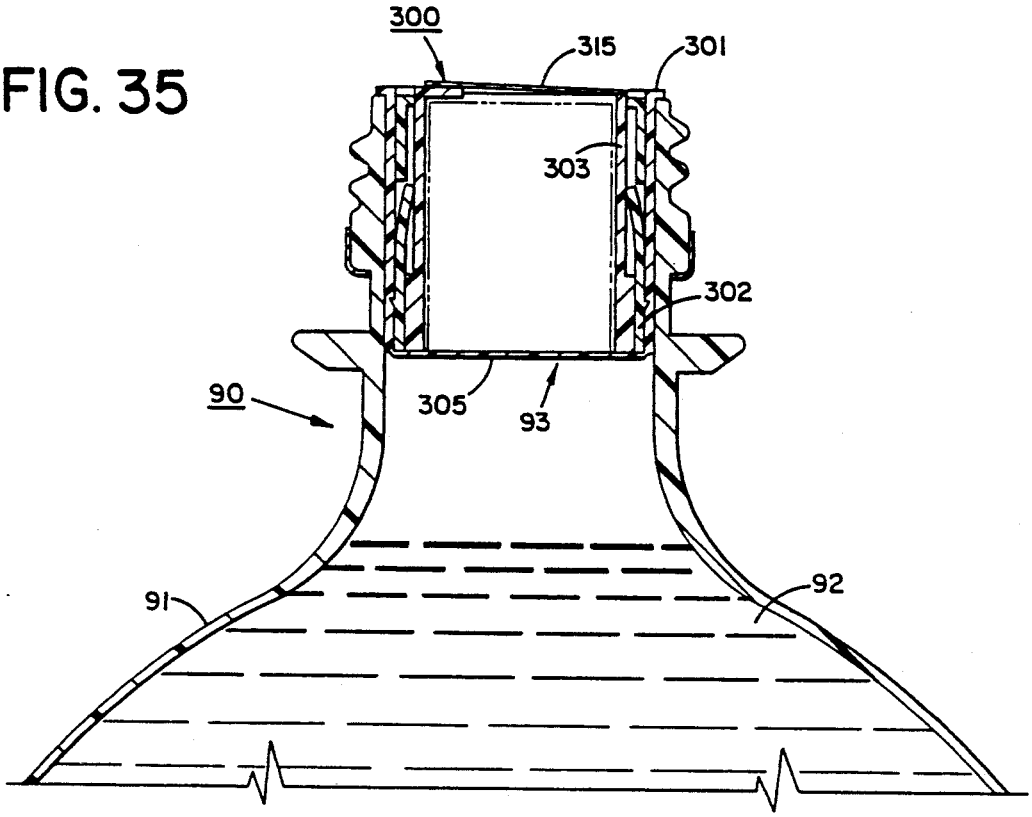
FIG. 35 is a cross-sectional side elevation view, partially broken away, of the embodiment of the container assembly of the present invention as depicted in FIG. 34.

Preferably, prize retaining zone 270 is formed by upstanding wall 272 which comprises a substantially cylindrically shaped prize retaining zone for ease of insertion and interengagement with cavity 253. In addition, upstanding wall 272 incorporates a plurality of inwardly extending dimples or recesses 273 formed on the outside surface thereof, which forms a part of the base locking system. As best seen in FIG. 27, cavity 253 incorporates outwardly extending bosses or pins 274 which are positioned for mating, locking interengagement with recesses 273 of keyway plate 267.

By employing this construction, prize 271 is positioned in holding zone 270 and securely affixed to the bottom of bottle 251 by aligning pins 259 in keyway 268 and rotating base 255 until base 255 is in secure, locked interengagement with bottle 251. Subsequent to this assembly, bottle 251 is filled with carbonated beverage 254 and then sealed, in the normal manufacturing procedure.

Once beverage 254 has been sealed in bottle 251, the inside surfaces of bottle 251 are exposed to a substantial increase in the interior pressure level, due to the sealed retention of the carbonated beverage therein. As a result, pins 274 are forced into locked engagement with recesses 273 of base 255. As a result, once prize holding container 250 of the present invention reaches a retail outlet as a randomly distributed container mounted with conventional non-prize bearing containers, base 255 is lockingly mounted in engagement with bottle 251, and prize bearing container 250 is indistinguishable from non-prize bearing containers.

In the present invention, the locked mating interengagement of pin 274 in recesses 273 prevents a consumer from attempting to rotate base 255 prior to opening bottle 251 and releasing the pressure contained therein. As a result, consumers are incapable of detecting a prize bearing container and the winning consumer will be the lucky individual who randomly selects the container without any knowledge that that container is prize bearing container 250.

Once a consumer opens the prize bearing container 250, the internal pressure is released therefrom causing pins 274 to disengage from recess 273 and enabling the consumer to rotate base 255 and disengage keyways 268 from locking pins 259. This allows the entire base 255 to be easily removed to obtain access to prize 271 in holding zone 270. In this way, once informed that the bottle is a winning bottle, the consumer can quickly and easily obtain the desired prize award.

Although this embodiment of the present invention has been depicted with a small cavity 253 for housing currency or an award certificate, any desired size cavity can be formed in bottle 251 in order to retain larger, more substantial prizes, such as watches, radios and the like. Regardless of the size of the prize being awarded, the same construction of the present invention can be employed.

In addition, the drawings and the foregoing description have detailed prize bearing container 250 in connection with the sale and distribution of carbonated beverages. However, as is apparent to one of ordinary skill in the art, this invention is not limited to carbonated beverages, and can be employed for awarding prizes in association with any liquid or moist product. Clearly, a removable prize holding housing can be affixed to any desired product bearing container, using the invention disclosed herein. Consequently, the present invention is not intended to be limited to the specific embodiment depicted in the drawings and the scope of the present invention is intended to encompass any container for wet or moist products.

In FIGS. 30–33, several alternate embodiments for a prize bearing container of the present invention are shown. Each of these embodiments represent alternate constructions for a prize container similar to holder 95 depicted in FIG. 10 in association with prize bearing container 90.

In FIGS. 30 and 31, prize holder 280 is depicted. In this embodiment, prize holder 280 is mounted in mouth 93 of a conventional beverage holding bottle 91, typically employed for carbonated beverages, as described above in relation to FIG. 10. Preferably, prize holder 280 is constructed from the identical plastic material employed for container 91 and is intimately bonded in mouth 93 of bottle 91.

As previously detailed, holder 280 is constructed with a size and shape rendering it impossible to be observed by the consumer prior to opening bottle 91. In addition, if desired, bottom surface 281 of holder 280 may be coated with a mirrored or metallic covering so as to enhance the reflection of the soda and bottle therebelow, thereby further rendering prize holder 280 visually undetectable.

In use, a consumer randomly selecting prize bearing container 90 opens bottle 91 in the normal manner, removing the sealing cap (not shown) therefrom. The consumer would either be informed by message disc 105 (FIG. 10) that a prize has been won or, alternatively, would immediately see the prize positioned in holder 280. Upon removal of the prize, the consumer would easily access the beverage contained in bottle 91 by pressing on elongated centrally disposed reduced thickness strip 282.

If desired, the side edges of reduced thickness strip 282 may be aligned with elongated cut-out zones or score lines, formed in bottom surface 281 or the opposed, top surface thereof, along both sides of strip 282. This establishes a mating elongated zone of a further reduced thickness along the base of holder 280. By exerting a downward force on elongated strip 282, strip 282 is forced inwardly into bottle 91, breaking base 281 of holder 280 along the cut-out zones or score lines.

As depicted in FIG. 31, strip 282 is constructed with one end thereof being disconnectible from holder 280, while the opposed end thereof is securely hinged to holder 280. As a result, once strip 282 has been forced downwardly to its fully pivoted position, as represented by arrow 284, base 281 of holder 280 incorporates a substantially enlarged opening through which the beverage contained in bottle 91 can be poured. In this way, the consumer is capable of winning a concealed prize award, as well as enjoying the product for which prize bearing bottle 90 had originally been purchased.

In an alternate construction, strip 282 comprises a greater thickness than base 281, in order to provide the user with greater leverage in opening strip 282. However, regardless of the thickness employed for strip 282, cut-out zones or score lines cooperating with strip 282 assure ease of dislocation of strip 282 from base 281.

If desired, holder 280 may incorporate elongated channels 100 and through holes 99 previously discussed in reference to FIG. 10 and holder 95. In this way, if so desired, the pressure caused by the carbonated beverage is released upon opening the sealing, by the passage of the pressure along elongated vertical channels 100 and through holes 99 as previously discussed.

Alternatively, since holder 280 is bonded directly to mouth 93 of bottle 91, the pressure will not force holder 280 to be dislodged prior to the dislocation of strip 282 from base 281. Consequently, if desired, the pressure relief channels can be eliminated and the internal pressure can be easily and safely released during the dislocation of strip 282 from base 281 of holder 280.

In FIGS. 32 and 33, an alternate embodiment for securing a visually undetectable prize bearing housing in a conventional beverage containing bottle is shown. In this embodiment, a uniquely constructed sealing cap assembly 290 is employed for being secured to beverage containing bottle 91. Prize containing housing 291 is securely affixed to the inside upper surface 292 of cap assembly 290. In addition, prize holding housing 291 is constructed with an overall diameter which allows cap assembly 290 to be securely sealingly mounted to bottle 91 in the conventional manner.

In use, a consumer selecting a prize bearing bottle 91 would remove cap 290 in the normal manner and observe prize bearing housing 291 secured thereto. In addition, bottom surface 293 of housing 291 could incorporate a suitable message informing the consumer that a prize award is retained in housing 291 along with instructions on the method to employ in order to access the prize award.

Typically, housing 291 would be constructed in a manner for being easily dislodged from its secured position, thereby allowing housing 291 to be easily removed in its entirety from cap 290, allowing the consumer to obtain the prize award contained therein. Preferably, housing 291 is simply glued or removably bonded to surface 292 of cap 290 in a manner which would allow housing 291 to be easily grasped by the consumer for rapid removal of housing 291 from cap 290. In this way, the consumer can quickly and easily obtain the prize award contained therein.

In FIGS. 34 through 38, an alternate embodiment is shown for providing a prize bearing container 90 incorporating a prize holding system which is visually undetectable by the consumer prior to opening container 90. For purposes of clarity and simplicity, all of the numerals referring to identical elements detailed above will be discussed using the same numerals, while new elements employ new reference numerals.

In this embodiment, prize bearing container 90 incorporates a bottle 91 in which the particularly desired beverage 92 is contained. For the reasons previously enunciated, the bottle depicted and described herein is conventionally employed for housing carbonated beverages.

In this embodiment, a prize holding assembly 300 is mounted in mouth 93 of bottle 91. In addition, prize holding assembly 300 is manufactured from the identical plastic material employed for bottle 91, with assembly 300 being securely bonded in mouth 93 of bottle 91. This construction provides assurance that prize holding assembly 300 cannot be forced outwardly from mouth 93 by the pressure exerted thereon by the carbonation of beverage 92.

Prize holding assembly 300 preferably comprises three coaxially aligned, telescopically engaged hollow cylindrically shaped members 301, 302 and 303, each of which are slidingly, matingly interengaged with each other. Outer cylindrically-shaped member 301 comprises the largest diameter of the telescopically engaged members and is securely bonded to mouth 93 of bottle 91. In addition, outer member 301 is closed at one end thereof by base 305, while being open at its opposed end, directly adjacent the opening to mouth 93 of bottle 91.

Intermediate cylindrically shaped member 302 comprises a diameter less than the diameter of outer member 301, in order to enable intermediate member 302 to be frictionally engaged with the inside walls of outer member 301, while also being capable of telescopic, sliding movement relative thereto. In the preferred embodiment, as will be detailed below, intermediate member 302 is constructed for sliding interengagement along the inside walls of outer member 301 in a direction towards beverage 92, while being incapable of being axially moved upwardly, out of contact with outer member 301.

In addition, intermediate cylindrically shaped member 302 incorporates a flange 307 positioned about the upper end of member 302 and extending inwardly therefrom. Member 302 also incorporates a plurality of inwardly-biased locking fingers 308 formed in the sidewall thereof, each positioned substantially the same distance below flange 307. As is further detailed below, flange 307 and locking fingers 308 cooperate to securely lock inner member 303 in its fully extended position.

In the preferred embodiment, in order to prevent the telescopic withdrawal of intermediate member 302 from outer member 301, stop means, in the form of a typical cylindrical ring or ridge 306 is formed about the outside surface of intermediate member 302 for cooperating, one-way disengagement from recess 312 formed in the inside surface of member 301. In this way, axial movement of intermediate member 302 past recess 312 is prevented, while axial sliding movement of intermediate member 302 relative to outer member 301 in the opposite, downward direction is freely allowed.

The construction of prize holding assembly 300 is complete by inside cylindrically-shaped member 303. Inside member 303 comprises a diameter smaller than the diameter of intermediate member 302, in order to enable inside member 303 to be slidingly, telescopically engaged with intermediate member 302.

In addition, in the preferred embodiment, inside member 303 comprises an outer peripheral wall 309 which comprises a larger diameter stepped ridge 310 peripherally surrounding the lower portion of member 303. If desired, larger diameter ridge 310 can be formed as a collar or simple extension ring peripherally surrounding the base of inside member 303 in order to prevent the complete axial removal of inside member 303 from intermediate member 302.

Figure 36:
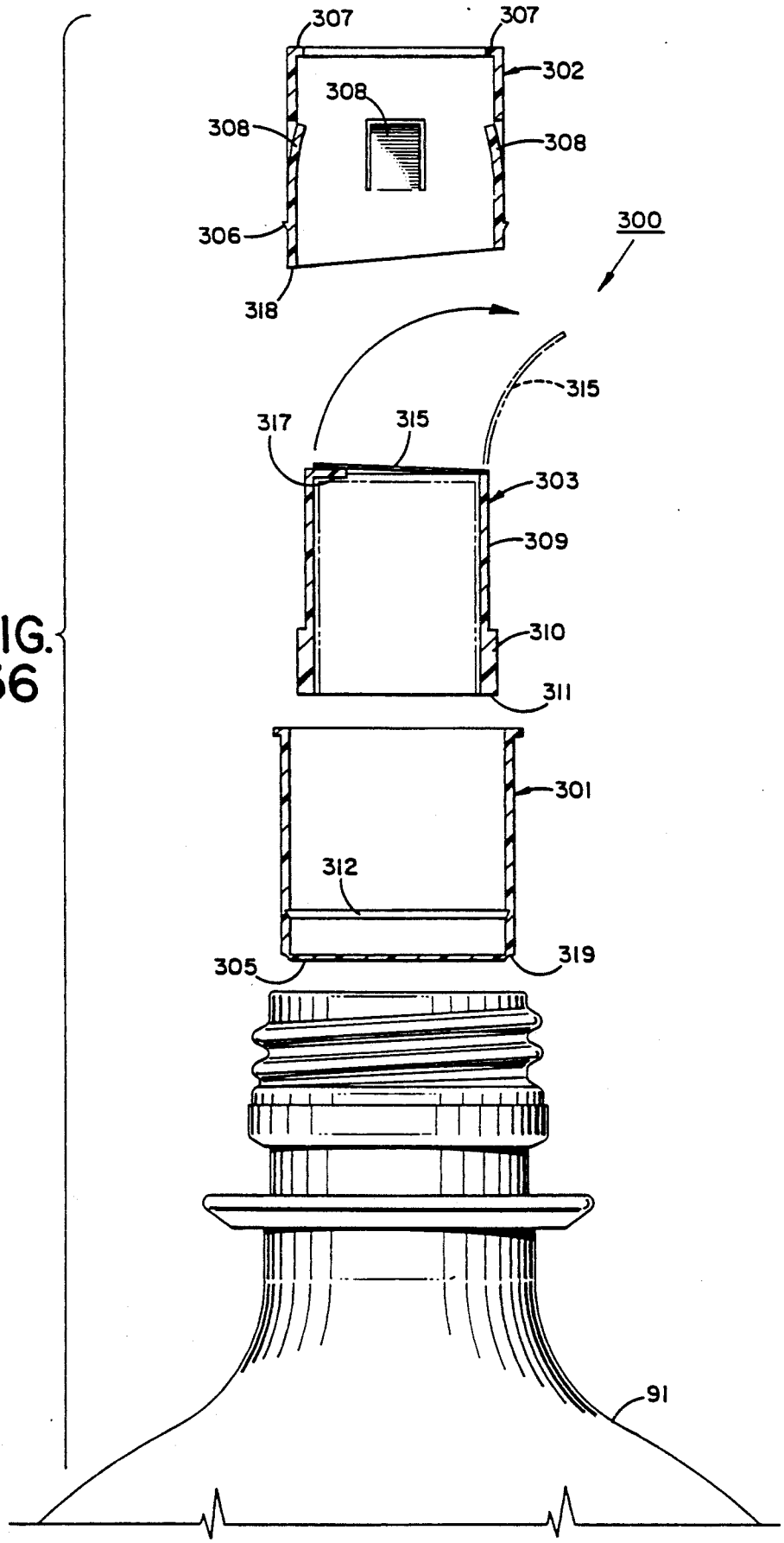
FIG. 36 is an exploded side elevation view, partially in cross-section and partially broken away, of the embodiment of the container assembly of the present invention depicted in FIGS. 34 and 35.
Figure 37:
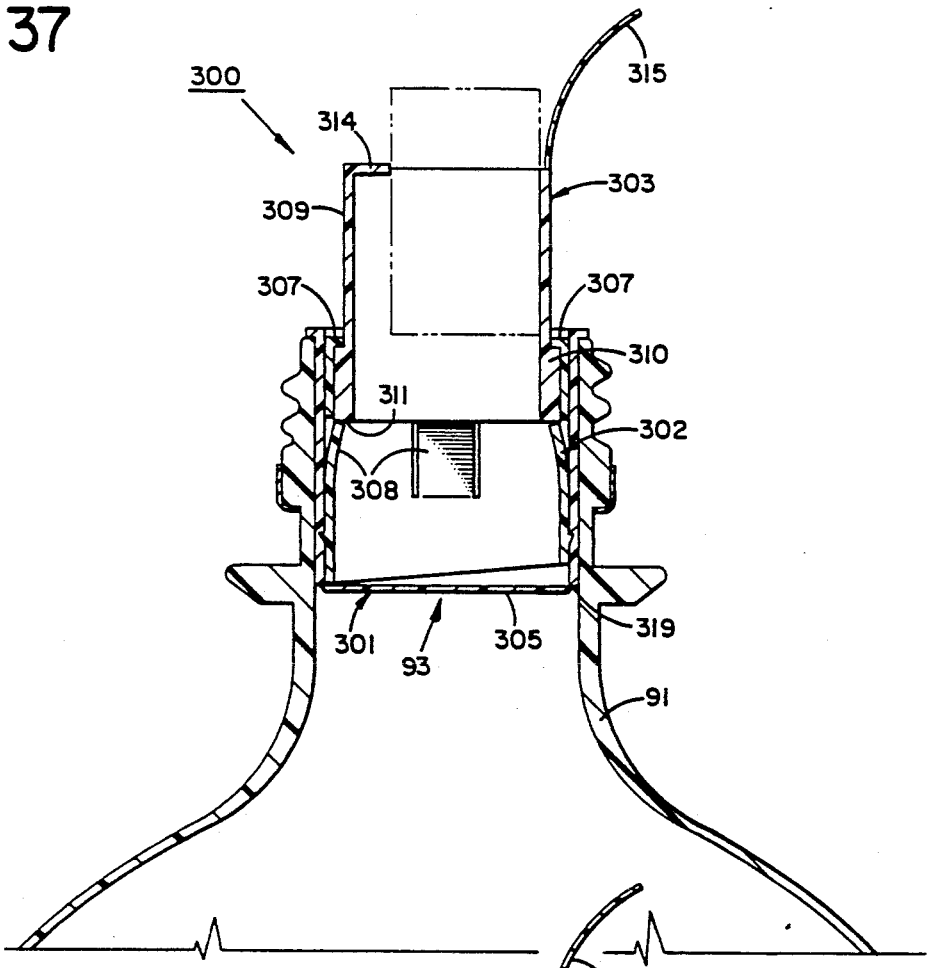
FIGS. 37 and 38 are cross-sectional side elevation views, partially broken away, of the embodiment of the container assembly of the present invention of FIGS. 34–36, shown in alternate sequential positions.
Figure 38:
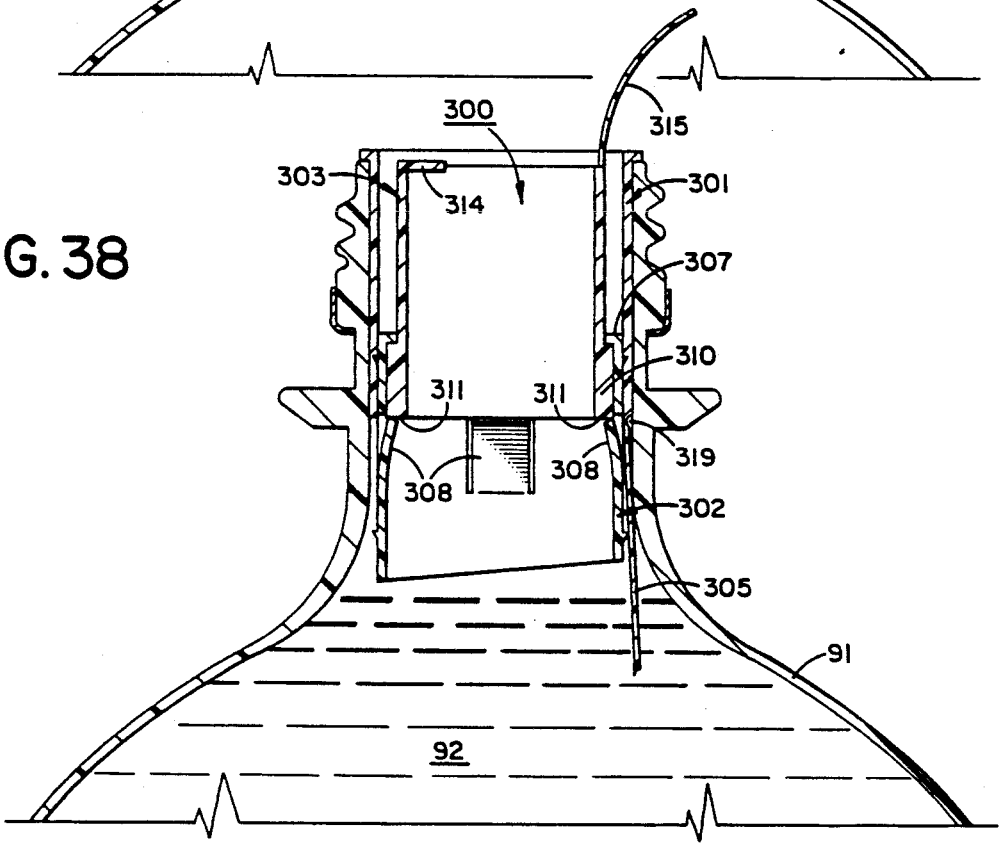

As shown in FIGS. 36–38, inwardly directed flange 307 formed about the top edge of intermediate member 302 provides a positive abutment stop for inside member 303, preventing the removal of inside member 303 from intermediate member 302. In addition, when in its fully upwardly extended position, bottom edge 311 of inner member 303 is locked in position by finger member 308 of intermediate member 302. As a result, once raised upwardly to its fully extended position, inner member 303 is locked in position, unable to move independent either upwardly or downwardly.

The construction of prize holding assembly 300 is completed by forming inside member 303 with an inwardly directed flange 314 and securely affixing a pull or lift strip 315 to inside member 303. If desired, the inside diameter of member 303 may be formed non-concentrically with the outer diameter of member 303. In this way, a thickened wall zone comparable to flange 314 is formed.

In addition, lift strip 315 is preferably securely anchored at one end thereof to inside member 303 diametrically opposed to flange 314. The opposed free end of strip 315 is positioned on flange 314 for easy removal therefrom.

In use, prize holding assembly 300 is secured in mouth 93 of bottle 91 in its fully telescopically engaged configuration. The desired prize, shown in phantom in the drawings, is mounted in prize holding assembly 300, resting on base 305 of outer member 301. Upon opening prize bearing container 90, the consumer would see the prize and would be informed to lift strip 315 in order to gain access to the prize.

After raising strip 315 and removing the prize award, the consumer pulls strip 315 upwardly, causing inner member 303 to telescopically advance upwardly until ridge 310 engages flange 307, preventing any further upward movement of inner member 303. In addition, when ridge 310 contacts flange 307, fingers 308 of intermediate member 302 are free to flex inwardly, lockingly engaging bottom edge 311 of inner member 303. As a result, inner member 303 is locked in position, unable to independently move either upwardly or downwardly.

In order to gain access to liquid 92 contained in bottle 91, the consumer merely pushes on thickened wall zone 314 of inner member 303. Since inner member 303 is lockingly engaged with intermediate member 302, the downward force causes both inner member 303 and intermediate member 302 to move downwardly, causing bottom edge 318 of intermediate member 302 to cuttingly engage base 305 of outer member 301.

In the preferred embodiment, bottom edge 318 of intermediate member 302 lies in a plane angularly disposed to the side surface of intermediate member 302. In this way, the downward force provided by the consumer is concentrated on selected areas of base 305, thereby enabling base 305 to be more easily broken away from outer cylinder 301.

If desired, a portion of base 305 may be scored or reduced in thickness in order to further enhance the dislocation of base 305 from outer cylinder 301. However, regardless of the particular configuration employed, base 305 preferably incorporates a living hinge zone 319 in order to prevent the complete removal of base 305 from outer member 301.

As shown in FIG. 38, the consumer continues to push inner member 303 and intermediate member 302 downwardly until base 305 has been disloged from inner member 301 and pushed against the inside wall of bottle 91, connected to inner member 301 by hinge zone 319. Intermediate member 302 assists in holding base 305 in its open position. In this way, the consumer is easily able to pour beverage 92 out of bottle 91, thereby being able to enjoy the product, as well as obtain a prize award.

It will thus be seen that the objects set forth above, among those made apparent from the preceding description, are efficient attained and, since certain changes may be made in the above products, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

We claim:

1. A container assembly, for use in association with liquid, semi-liquid and moist products, constructed for housing a prize award and being randomly distributed with non-prize bearing containers without being detected by the consumer prior to opening thereof, said container assembly comprising:

A. an outer surface defining shell
   a. identical in appearance to the product bearing shell normally employed for the liquid, semi-liquid or moist product;
   b. defining an internal retaining zone; and
   c. comprising at least one entry portal formed at one end thereof;

B. closure means cooperatively associated with the outer shell for closing the entry portal thereof;

C. means positioned in the retaining zone for providing the container assembly with the sound, weight and feel of the product normally contained therein;

D. holding means cooperatively positioned in association with the retaining zone in cooperating relationship to the entry portal for securely retaining a prize award; and E. a prize award positioned in secure, secret, and undiscoverable retention with the holding means and remaining undiscoverable until the container assembly is opened for gaining access to the internal retaining zone;

whereby a prize award holding container assembly for liquid, semi-liquid and moist products is achieved for being randomly distributed with non-prize bearing, product-holding containers without fear of being detected by the consumer prior to opening thereof.

2. The container assembly defined in claim 1, wherein said means positioned in the retaining zone is further defined as comprising the actual liquid, semi-liquid or moist product being sold.

3. The container assembly defined in claim 2, wherein said holding means is further defined as comprising a substantially cylindrically-shaped cup member a. open at one end thereof and closed at the opposed end;

b. dimensioned for matingly engaging with the inside wall of the entry portal of the outer shell, and c. comprising a flange portion integrally engaged with and peripherally surrounding the upper edge of said cup member and dimensioned for being retainingly engaged about the top edge of said entry portal, whereby said holding means is securely retained in juxtaposed, spaced cooperating relationship with said entry portal of the retaining zone.

4. The container assembly defined in claim 3, wherein the closure means is further defined as comprising a cap engageable with the outer peripheral surface of the shell, directly adjacent the entry portal, thereby peripherally surrounding and visually obscuring the presence of said holding means.

5. The container assembly defined in claim 4, wherein shell comprises a transparent container and said holding means is further defined as comprising a mirrored surface for reflecting the surrounding area, thereby being incapable of detection by individual observation.

6. The container assembly defined in claim 4, wherein said means positioned in the retaining zone comprises carbonated beverages and said holding means is further defined as incorporating pressure release channels formed therein for allowing release of any built-up pressure when the closure means is open.

7. The container assembly defined in claim 4, wherein said cup member is further defined as being removably mounted in the entry portal of the outer shell for providing access to the product contained in said shell.

8. The container assembly defined in claim 4, wherein said cup member is further defined as being securely affixed in the entry portal of the outer sheel, thereby preventing removal of said cup member therefrom in its entirely, and said cup member is further defined as comprising a dislocatable portion formed along the base of the cup member enabling the user to dislocate the base from the cup member, when desired, thereby attaining access to the liquid contained in said shell.

9. The container assembly defined in claim 8, wherein said cup member is further defined as being formed from the same material as the shell and is intimately bonded therewith.

10. The container assembly defined in claim 8, wherein said dislocatable portion of said base of said cup member is further defined as comprising a zone of reduced thickness formed therein which is capable of sealingly holding the product in the shell while also being easily dislocatable by the user when accessed to the product is desired.

11. The container assembly defined in claim 10, wherein said zone of reduced thickness is further defined as comprising a hinge section matingly engaged with the cup member to prevent complete separation of the dislocatable portion from said cup member.

12. The container assembly defined in claim 2, wherein the closure means is further defined as comprising a cap engageable with the outer peripheral surface of the shell, directly adjacent the entry portal, and said holding means is further defined as comprising a substantially cylindrically shaped cup member a. open at one end thereof and closed at the opposed end, b. dimensioned for insertion within the inside wall of the entry portal of the outer shell, and c. removably secured at its upper, open end to the inside surface of said cap, whereby said holding means is securely retained in juxtaposed, spaced cooperating relationship with the entry portal of the retaining zone when the cap is sealed to the portal of the shell and automatically removed from the entry portal when the cap is removed from the shell, with the holding means being easily removed from the cap for access to the prize retained therein.

13. The container assembly defined in claim 12, wherein said cup member is further defined as comprising a flange portion peripherally surrounding the open upper edge of said cup member and dimensioned for being retainingly engaged in said cap and about the upper edge of said entry portal to assure secure mating interengagement with said cap and said shell in the closed configuration, as well as complete removal and accessibility when the cap has been removed from the shell.

14. The container assembly defined in claim 2, wherein said holding means is further defined as comprising at least two telescopically engaged members comprising a. a first outer member comprising 1. a substantially cylindrical shape, open at one end thereof and closed at the opposed end, 2. dimensioned for matingly engaging with the inside wall of the entry portal of the outer shell, and 3. intimately bonded with the inside wall of the entry portal of the outer shell, thereby preventing movement thereof relative to said shell;

b. a second inner member dimensioned for telescopic sliding engagement within the first outer member; and c. surface engaging and dislocating means positioned in juxtaposed spaced relationship with the base of said first outer member for providing contacting, dislocating engagement of the base of said first outer member upon the application of a downward force by the user, whereby the closed end base of said first, outer member is dislocated for access to the product contained in said shell.

15. The container assembly defined in claim 14, wherein said holding means is further defined as comprising c. a third intermediate member telescopically engaged between said first outer member and said second inner member and incorporating 1. a holding flange positioned about the upper rim thereof to prevent withdrawal of said inner second member therefrom, 2. a plurality of locking fingers biased inwardly for lockingly engaging the inner second member in its fully extended position, and 3. said surface engaging and dislocating means being further defined as formed on the lower edge of said third, intermediate member, thereby enabling the third intermediate member to breakingly engage the base of said first outer member, dislocating the base therefrom and obtaining access to the product contained in the shell.

16. The container assembly defined in claim 15, wherein the first outer member is further defined as comprising a hinge zone formed between the base thereof and the cylindrical side walls, preventing complete dislodgement of the base therefrom.

17. The container assembly defined in claim 16, wherein the second inner member and third intermediate member are further defined as being telescopically movable in locked engagement relative to the first outer member into the shell, after the base has been dislocated from the first outer member, causing said dislocated portion to be forced against the sidewall of the shell, thereby assuring complete access to the product contained therein.

18. The container assembly defined in claim 2, wherein said holding means is further defined as comprising a. a prize containing recess zone formed in the outer surface of the shell; and b. a removable cover assembly 1. lockingly mounted to the shell in concealing, overlying relationship with the prize retaining recess zone, and 2. cooperatively associated with the closure means for being removably unlocked when the closure means is removed from the entry portal.

19. The container assembly defined in claim 18, wherein said prize retaining recess zone is further defined as being formed in the base of the shell outside of said internal retaining zone and comprising a size and shape constructed for holding the particular desired prize award.

20. The container assembly defined in claim 19, wherein said removable cover assembly is further defined as comprising 3. a keyplate mounted to the base of the shell and incorporating i. an aperture zone positioned in juxtaposed spaced cooperating aligned relationship with the prize retaining recess zone for providing access thereto, and ii. a plurality of locking pins extending therefrom, and 4. a base member positioned in overlying retained engagement about the base of the shell, i. peripherally surrounding and visually obscuring the prize retaining recess zone and keyplate, and ii. incorporating a keyway plate securely affixed therein for lockingly engaging the pins of the keyplate, thereby securely affixing the base member to the shell.

21. The container assembly defined in claim 20, wherein said removable cover assembly is further defined as comprising an elongated, substantially cylindrical tube member secured to the base and aligned for cooperative, sliding interengagement with the prize retaining recess zone of the shell, the tube member and the prize retaining recess zone being further defined as comprising cooperating locking pins and recesses formed on the surfaces thereof to assure secure, locked interengagement of said tube within said recess zone when the closure means are mounted to the shell, while providing automatic removal of pins from said recesses when the closure means are removed from the shell.

22. The container assembly defined in claim 21, wherein said substantially cylindrical tube is further defined as being formed on the keyway plate and securely affixed to the base member with said keyway plate.

23. The container assembly defined in claim 22, wherein said shell, keyplate, keyway plate and base are all further defined as comprising substantially circular components in cross section with the cylindrical tube, aperture and prize retaining recess zone all being in coaxial alignment with each other.

24. A container assembly, for use in association with liquid, semi-liquid and moist products, constructed for housing a prize award and being randomly distributed with non-prize bearing containers without being detected by the consumer prior to opening thereof, said container assembly comprising:

A. an outer surface defining shell
  a. identical in appearance to the product bearing shell normally employed for the liquid, semi-liquid or moist product;
  b. defining an internal retaining zone; and
  c. comprising at least one entry portal formed at one end thereof;
B. closure means cooperatively associated with the outer shell for closing the entry portal thereof;
C. means positioned in the retaining zone for providing the container assembly with the sound, weight and feel of the product normally contained therein;
D. holding means cooperatively positioned in association with the retaining zone in cooperating relationship to the entry portal for securely retaining a prize award and comprising:
  a. a housing positioned in the retaining zone and incorporating an elongated channel, and
  b. a prize retaining member
    1. mounted in the elongated channel, and
    2. movable from a first secured position to a second released position in juxtaposed protruding relationship with the entry portal of the shell; and
E. a prize award positioned in secure, secret, undiscoverable retention with the holding means and remaining undiscoverable until the container assembly is opened for gaining access to the internal retaining zone whereby a prize award holding container assembly for liquid, semi-liquid and moist products is achieved for being randomly distributed with non-prize bearing, product-holding containers without fear of being detected by the consumer prior to opening thereof.

25. The container assembly defined in claim 24, wherein the elongated channel of the housing is further defined as defining a pathway along which the prize retaining member travels between its two alternate positions, assuring movement of the prize retaining member through the entry portal when the prize retaining member moves from its first position to its second position.

26. The container assembly defined in claim 25, wherein said holding means further comprises c. spring means positioned in cooperating relationship with the prize retaining member at the base of the elongated channel to provide automatic movement of the prize retaining member from its first position to its second released position.

27. The container assembly defined in claim 26, wherein said holding means is further defined as incorporating d. position lock means for securely latching the prize retaining member in its second released position in protruding relationship with the entry portal.

28. The container assembly defined in claim 27, wherein said position lock means comprises at least two spring biased arms 1. mounted along the side surfaces of the prize retaining member and maintained in an unlatched position within the channel when the prize retaining member is in its first position, thereby allowing the holding means to move freely from its first position to its second position; and
2. movable laterally outwardly when the prize retaining member has moved into its second position, whereby said lock means securely engages the terminating edge of the channel, latching the prize retaining member in its second position.

29. The container assembly defined in claim 26, wherein the holding means is further defined as comprising d. securing means
  1. cooperatively associated with the prize retaining member for maintaining the prize retaining member in its first position, against the force of the spring means, and
  2. cooperatively associated with the opening of the entry portal for automatically releasing the prize retaining member, thereby allowing the prize retaining member to automatically move from its first retained position to its second released position, with a portion of the prize retaining member extending through the entry portal, thereby presenting the prize award to the consumer.

30. The container assembly definded in claim 29, wherein the closure means comprises a lid incorporating a tab release formed thereon and said portal opening for releasing the prize retaining member comprises a tab release mounted on the lid thereof.

31. The container assembly defined in claim 30, wherein said securing means comprises an elongated, flexible arm positioned in contacting relationship with the prize retaining member for maintaining the prize retaining member in its first position, with said arm being positioned for deflection upon the pulling of the tab release formed on the container lid, said movement causing said elongated arm to disengage from the prize retaining member, thereby allowing the prize retaining member to be automatically moved into its second position, with a portion thereof extending through the opened portal of the container assembly.

32. The container assembly defined in claim 31, wherein said elongated arm is further defined as extending from a support plate removably mounted in the housing.

33. A container assembly, for use in association with liquid, semi-liquid and moist products, constructed for housing a prize award and being randomly distributed with non-prize bearing containers without being detected by the consumer prior to opening thereof, said container assembly comprising:

A. an outer surface defining shell
  a. identical in appearance to the product bearing shell normally employed for the liquid, semi-liquid or moist product;
  b. defining an internal retaining zone; and c. comprising at least one entry portal formed at one end thereof;

B. closure means cooperatively associated with the outer shell for closing the entry portal thereof;

C. means positioned in the retaining zone for providing the container assembly with the sound, weight and feel of the product normally contained therein; and D. holding means cooperatively positioned in association with the retaining zone in cooperating relationship to the entry portal for securely retaining a prize award and comprising:

a. a housing positioned in the retaining zone and incorporating an elongated channel, b. a prize retaining member 1. mounted in the elongated channel, and 2. movable from a first secured position to a second released position in juxtaposed protruding relationship with the entry portal of the shell; and c. a flange portion peripherally surrounding the elongated channel and dimensioned for mating, overlying, sealing engagement with the entry portal of the shell whereby a prize award holding container assembly for liquid, semi-liquid and moist products is achieved for being randomly distributed with non-prize bearing, product-holding containers without fear of being detected by the consumer prior to opening thereof.

34. The container assembly defined in claim 33, wherein said shell is further defined as comprising a metal container conventionally employed for housing carbonated beverages and the flange of the holding means is further defined as being intimately bonded in sealing engagement with the portal of said shell, thereby sealingly closing the shell with the elongated channel extending into the retaining zone from the flange, sealingly securing the liquid means contained in said shell between the interior walls thereof and the holding means for providing the same sound, weight and feel of the normal product contained therein and said container assembly further comprising a closure lid normally employed with the shell incorporating a preformed tab release formed thereon intimately bonded to the top surface of said flange, thereby attaining a container assembly housing a desired prize award which is completely indistinguishable from non-prize bearing containers for the product.

35. The container assembly defined in claim 34, wherein said holding means is further defined as comprising an enlarged central chamber positioned between the flange and the channel, incorporating a receiving zone for movement of the tab release of said lid.

36. The container assembly defined in claim 35, wherein said prize retaining member is further defined as comprising an alignment fin extending from the outer surface thereof and the elongated channel is further defined as comprising a fin receiving slot, cooperatively associated with the fin of the prize retaining member for assuring that the prize retaining member moves in a precisely desired pathway from its first position to its second release position protruding through the opening formed in the lid by the tab release, while also assuring that the prize retaining member is incapable of completely exiting through the opening of said lid.

* * * * *